US006866367B2

(12) United States Patent
Szumla

(10) Patent No.: US 6,866,367 B2
(45) Date of Patent: Mar. 15, 2005

(54) INK JET PRINTING SYSTEM USING A FIBER OPTIC DATA LINK

(75) Inventor: Thomas P. Szumla, Lockport, NY (US)

(73) Assignee: Eastman Kodak Company, Rochester, NY (US)

( * ) Notice: Subject to any disclaimer, the term of this patent is extended or adjusted under 35 U.S.C. 154(b) by 130 days.

(21) Appl. No.: 10/325,190

(22) Filed: Dec. 20, 2002

(65) Prior Publication Data

US 2004/0119781 A1 Jun. 24, 2004

(51) Int. Cl.[7] ..... B41J 2/16
(52) U.S. Cl. ..... 347/50
(58) Field of Search ..... 347/50, 20, 84–87, 347/37; 400/174

(56) References Cited

U.S. PATENT DOCUMENTS

| | | | | |
|---|---|---|---|---|
| 5,396,078 A | | 3/1995 | Klaus et al. | |
| 5,676,475 A | * | 10/1997 | Dull | 400/174 |
| 5,706,040 A | * | 1/1998 | Reid et al. | 347/50 |
| 6,079,821 A | | 6/2000 | Chwalek et al. | |
| 6,174,046 B1 | * | 1/2001 | Reid et al. | 347/50 |
| 6,357,859 B1 | | 3/2002 | Klees | |

OTHER PUBLICATIONS

U.S. Appl. No. 09/960,109, filed Sep. 21, 2001, entitled: Printhead Assembly with Minimized Interconnections to an Inkjet Printhead, Madziarz et al.

U.S. Appl. No. 10/091,320, filed Mar. 5, 2002, entitled: Printhead Assembly with Shift Register Stages Facilitating Cleaning of Printhead Nozzles, Madziarz et al.

U.S. Appl. No. 09/607,840, filed Jun. 30, 2000, entitled: Drop On Demand Ink Jet Printer Capable of Directional Control of Ink Drop Ejection and Method of Assembling the Printer, Lee et al.

U.S. Appl. No. 09/662,253, filed Sep. 14, 2000, entitled: Image Processor for High Speed Print Applications, Szumla et al.

* cited by examiner

*Primary Examiner*—K. Feggins
(74) *Attorney, Agent, or Firm*—Norman Rushefsky; Mark G. Bocchetti

(57) ABSTRACT

A method and apparatus for transmitting data to a printhead by moving a carriage while the printhead records on a receiver medium. The printhead includes a plurality of recording elements and first electronic circuitry is also mounted with the printhead on the carriage for bi-directional movement with the carriage. An optical data link is coupled to the first electronic circuitry. The optical data link carries image data signals from second electronic circuitry remote from the carriage. A multiplexer multiplexes image data signals for transmission to the optical data link. The first electronic circuitry on the carriage includes a demultiplexer that demultiplexes the image data into signals for operation of the printhead.

51 Claims, 18 Drawing Sheets

SEE FIG. 5
28a1
28b1
28a2
28b2
28aN
28bN
28aN+1
28bN+1
28aN+2
28bN+2
28a2N
28b2N
UPPER_ENABLE
LOWER_ENABLE
UPPER_LATCH
LOWER_LATCH
DATA U 0
UPPER_CLOCK
DATA U 1
DATA U M
DATA L 0
LOWER CLOCK
DATA L 1
DATA L M
N-bits SERIAL SHIFT REGISTER 0
N-bits SERIAL SHIFT REGISTER 1
N-bits SERIAL SHIFT REGISTER M
N-bits SERIAL SHIFT REGISTER 0
N-bits SERIAL SHIFT REGISTER 1
N-bits SERIAL SHIFT REGISTER M
80
88
90
91
92
94
100
102
104
106

INK JET PRINTING SYSTEM USING A FIBER OPTIC DATA LINK

CROSS-REFERENCE TO RELATED APPLICATION

This application is related to application Ser. No. 09/960,109, filed Sep. 21, 2001, and entitled "Printhead Assembly with Minimized Interconnections to an Inkjet Printhead" and to application Ser. No. 10/091,320, filed Mar. 5, 2002 and entitled "Printhead Assembly with Shift Register Stages Facilitating Cleaning of Printhead Nozzles" both filed in the name of Madziarz et al.

FIELD OF THE INVENTION

The invention relates in general to a recording apparatus such as an inkjet printhead and, more specifically, to a printer assembly that reduces the number of electrical interconnections to an inkjet printhead. More particularly, the invention relates to the use of a fiber optic transmission line to achieve reduced electrical wire count by multiplexing the needed electrical signals for the print head into the fiber optic link.

BACKGROUND OF THE INVENTION

Without limiting the scope of the invention, its background is described in connection with thermal inkjet printers, as an example.

Modern printing relies heavily on inkjet printing techniques. The term "inkjet" as utilized herein is intended to include all drop-on-demand or continuous inkjet printer systems including, but not limited to, thermal ink-jet, piezoelectric, and continuous, all of which are well known in the printing industry. Essentially, an inkjet printer produces images on a receiver medium, such as paper, by ejecting ink droplets onto the receiver medium in an imagewise fashion. The advantages of non-impact, low-noise, low-energy use, and low cost operation, in addition to the capability of the printer to print on plain paper, are largely responsible for the wide acceptance of inkjet printers in the marketplace. The printhead is the device that is most commonly used to direct the ink droplets onto the receiver medium. A printhead typically includes an ink reservoir and channels, which carry the ink from the reservoir to one or more nozzles.

There are practical limitations in the number of interconnections that can be implemented in order to make the design useful and operable. At the same time, by serializing a large number of data and control lines can result in a loss of timeliness of the data. The use of copper wire for the transmission of these signals has disadvantages such as added weight and bulk to the cable harness to the print head and because of electrical effects such as cable capacitance, crosstalk, and propagation delays (associated with long cable lengths). These design constraints make transmission of print head data by way of copper wire less attractive than by using a fiber optic transmission technique.

Prior art U.S. Pat. Nos. 5,396,078 and U.S. Pat. No. 6,357,859 describe the use of fiber optic data transmission for a printer. However, the prior art does not apply the technique of multiplexing to the fiber optic data channel to maximize the use of the wide bandwidth available with fiber optic transmission techniques to replace a number of electrical signals transmitted over copper wire. Also, this prior art describes a printer design where the print head carriage assembly does not contain the controller but discloses instead that the controller is located remotely to the print head and linked to the printhead by way of the fiber optic link.

U.S. Pat. No. 5,676,475 describes a printing system where the controller is located with the print head on the printer carriage. This implementation involves data rates of around 160 Kbytes per second and bursts of data up to 2 Mbytes per second. Also, this prior art describes a typical printer as containing 200 firing jets or nozzles. This implementation also utilizes a fiber optic data link. The data link is positioned such that it brings externally generated printer data to the controller, which is located with the print head at the printer carriage. No use of multiplexing is disclosed in the description of the fiber optic interface shown.

It is desirable, particularly in high speed industrial printing applications such as (1) the printing of wallpaper, the printing of photographs as examples of a drum or web type printing machinery or (2) for the printing of corrugated, packaging material, printing plates (flexographic or lithographic), or other media that necessitates the use of a flatbed type platen with an overhead x-y positionable carriage with print heads, that the quantity of electronic circuitry be minimized as much as possible that is packaged upon the carriage. The location of a controller or print engine on the carriage (1) adds significant circuitry that includes microprocessor clocks and circuits that contribute potential electrical interference and (2) may require special protection from inkjet fluids, such as conformal coating and (3) they and their power supply circuits add to the weight borne by the carriage, thus adding cost and complexity to the mechanical design and (3) these additional circuits add bulk and weight to the power cable assembly linking the carriage to the main section of the printing machinery. Thus it is desirable in high speed and/or large inkjet printing array assemblies to minimize the quantity of electronic circuits located on the print head carriage.

Accordingly, a printer assembly utilizing the fiber optic transmission method with multiplexing of the data provides advantages over prior art methods of transmitting data to the print heads where the controller is remotely located from the print head

SUMMARY OF THE INVENTION

The present invention provides a solution to presenting a large number of discrete data items in a timely fashion to a inkjet print head. Further more, the characteristics of the materials that comprise a fiber optic cable lend themselves to implementing the system with minimal cable bulk and stiffness such that the data transmission assembly lends itself to enabling the designer to create printing machines that are of different architectures to work with different media in a variety of applications. Examples include implementations such as flat bed printers, drum based media platforms, and conveyer belt driven media feed systems. The light weight of the fiber cable materials enables the user to design a system such that the print head assembly can be implemented with a frame and support assembly with much less weight.

Disclosed is an inkjet printhead comprising a plurality of nozzles having corresponding nozzle openings for selectively delivering ink drops onto a specified receiver medium and a plurality of shift registers operably coupled to the actuators associated and adapted to cause ink to be delivered through the nozzles openings in the direction of the receiver medium. These print heads may consist of a large array of nozzles, 1024 nozzles as an example. A print data driving means is operably coupled to the shift registers via a plurality of interconnections and these signals are in turn carried over a fiber optic link between the shift registers and print signal generating circuitry in the printing machinery. A data rate of at least 20 Mbytes/sec may be used for a high speed printing application that uses this system.

In accordance with the invention, there is provided a printer apparatus comprising a carriage supported for movement in a fast scan direction of printing on a receiver medium, the carriage supporting a printhead for recording information on the receiver medium, the printhead having a plurality of recording elements; first electronic circuitry mounted on the carriage for bi-directional movement with the carriage; an optical data link for providing to the first electronic circuitry image data signals for recording by the printhead; second electronic circuitry located remotely from the carriage and coupled to the first electronic circuitry by the optical data link, the second electronic circuitry providing multiplexed image data signals for transmission to the optical data link; and wherein the second electronic circuitry includes a multiplexer for multiplexing image data signals for transmission to the optical data link and the first electronic circuitry includes a demultiplexer for demultiplexing the image data signals.

In accordance with another aspect of the invention, there is provided a method for transmitting data to a printhead comprising the steps of moving a carriage in a fast scan direction while the printhead records on a receiver medium, the carriage supporting the printhead for recording on the receiver medium, the printhead having a plurality of recording elements, and first electronic circuitry being mounted on the carriage for bi-directional movement with the carriage; providing an optical data link to the first electronic circuitry, the optical data link carrying image data signals from second electronic circuitry remote from the carriage; and multiplexing image data signals for transmission to the optical data link and the first electronic circuitry on the carriage including a demultiplexer that demultiplexes the image data into signals for operation of the printhead.

In a preferred embodiment the interconnections include data lines for delivering print data signal and clock lines for delivering timing signals to lower and upper shift registers. The data lines may be interleaved between upper shift registers and lower shift registers. The print data driving means is configured to operate the clock lines by transmitting a clock signal that causes upper and lower shift registers to shift data received over data lines and thereby operate the plurality of heaters.

Further disclosed is an inkjet printer comprising a printhead nozzle assembly with a plurality of nozzles, each of the nozzles comprising a nozzle opening through which ink in the form of ink drops is ejected. An ink supply system is configured to supply ink to the printhead nozzle assembly with data path and control electronics circuitry operably coupled to the printhead nozzle assembly for providing image data to the printhead nozzle assembly. The printer further comprises means for delivering the image data to the printhead nozzle assembly. The printhead nozzle assembly further comprises heater elements configured to actuate each of the nozzles for printing.

The data path and control electronics circuitry comprises a plurality of shift registers configured to drive the nozzles by causing them to deliver ink in the direction of a receiver media. The data path and control electronics circuitry further comprises a print data driver operably coupled to the shift registers and configured to deliver print data at specified times to the shift registers in order to cause the nozzles to deliver ink at specified locations and at specified times on the receiver media. The data for high speed printing routed between a nozzle controller and a printhead (the printhead being placed remotely from the nozzle controller on the printer carriage) observes high data rates applicable for industrial printing applications listed above and would benefit from being implemented using a fiber optic link.

The fiber optic link implemented between the print head or printer carriage electronics and the printer's print engine multiplexes a number of low frequency electronic signals into a higher bandwidth capability fiber optic cable system. The multiplexing scheme can be implemented using either time division multiplexing or frequency division multiplexing techniques. The circuit to (1) fold in or multiplex signals destined to the printhead, and (2) feedback or status signals originating at the printhead (such as monitoring printhead temperature) are demultiplexed at the print engine. Likewise, at the printhead or printer carriage, assembly signals (1) destined from the print engine to the printhead are demultiplexed here and (2) signals originating at the printhead and destined for the print engine are multiplexed here as well.

A technical advantage of the present invention is that a large number of electrical signals required for a printhead can be transmitted in a lightweight and mechanically advantageous way.

Another technical advantage is that the fiber optic transmission method enables electrical signals to be transmitted a significant distance without signal degradation due to parasitic capacitance or cable resistance. The signals are also protected from degradation due to electric and magnetic field interference while they are in the fiber optic medium.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

While the making and using of various embodiments of the present invention are discussed in detail below, it should be appreciated that the present invention provides many applicable inventive concepts which can be embodied in a wide variety of specific contexts. For example, the specific embodiments discussed herein are described in the context of nozzles used in an inkjet printhead which act as recording elements for recording images on a receiver medium, such as paper. It should understood, however, that other types of recording elements such as LEDs, thermal recording elements, and lasers, among others may benefit from the advances provided by the invention. The specific examples discussed herein are merely illustrative of specific ways to make and use the invention, and do not delimit the scope or application of the invention.

Figure 1:
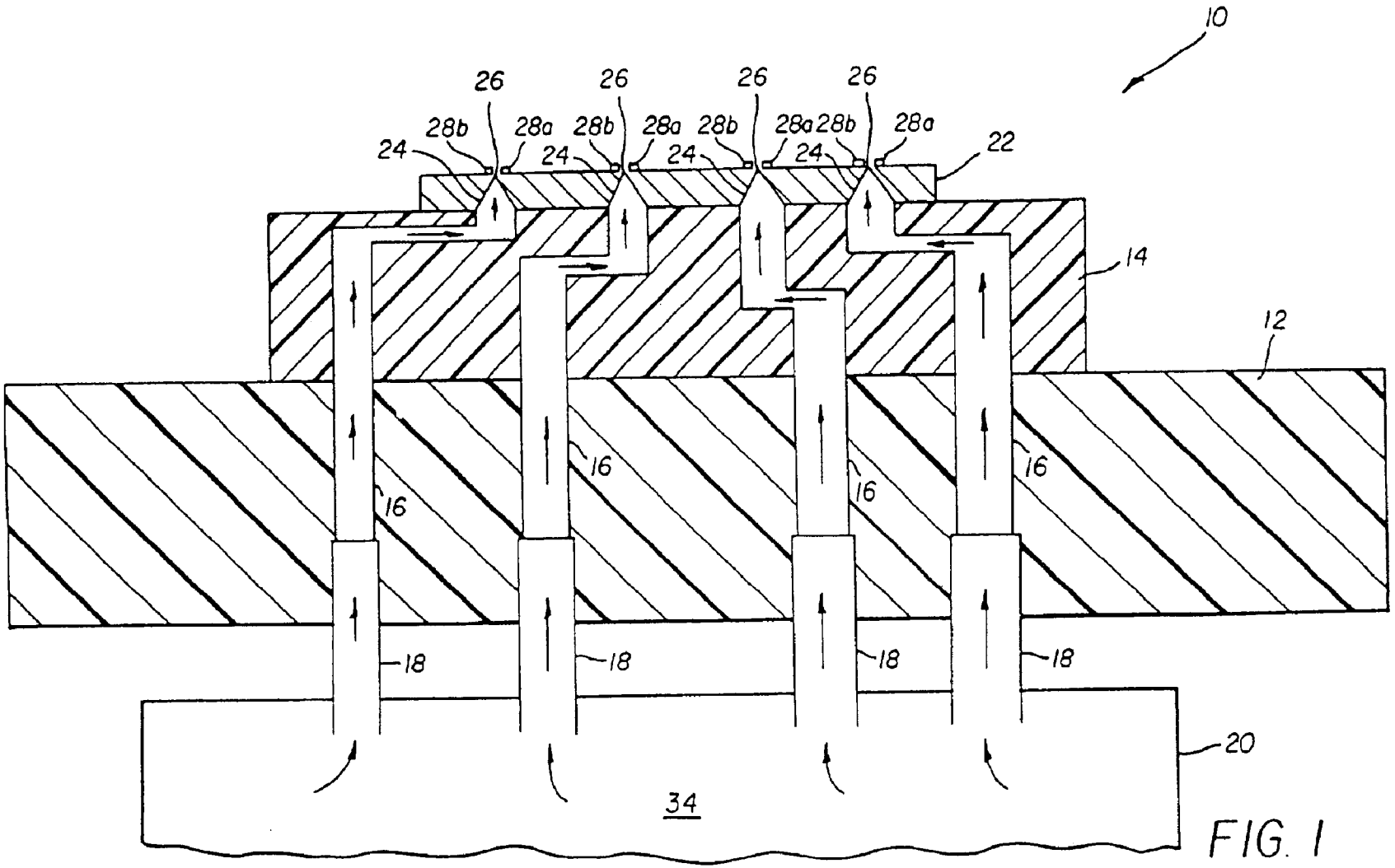
FIG. 1 is a diagram illustrating an inkjet printhead with a plurality of nozzle openings through which ink flows.

Referring to FIG. 1, therein is shown a cross-section of an inkjet printhead 10 of the type commonly employed in thermal inkjet printers. More specifically, inkjet printhead 10 is a device that is commonly used to direct ink droplets or "drops" onto a receiver medium, such as paper, in an inkjet printer (not shown) and comprises one of several types of recording apparatus to which the invention may be applied. With the inkjet printhead 10, ink drops exit rapidly enough so as to form an ink drop stream. The terms "ink drops", "ink droplets", "ink stream", and "ink" will be used interchangeably throughout.

Inkjet printhead 10 includes an ink reservoir 20, fluid-flow channels 18 and inlet/outlet tubes 16 which carry the ink 34 from the reservoir 20 to one or more recording elements or nozzles 24. For convenience and conformity to the figures, the term "nozzles" will be used throughout although it should be understood that nozzle comprises but a single type of recording element to which the invention may be applied. Inkjet printhead 10 also comprises a mounting block 12, a manifold 14, and a substrate 22 which internally define the tubes 16 and fluid flow channels 18, providing paths from the ink reservoir 20 to the nozzles 24. Typically, the number of nozzles 24 is numerous providing an inkjet printhead with as many as 160, 320 or 1,280 nozzles, according to the design resolution and quality of printhead assembly. Typically, the nozzles may be positioned at 300 dots per inch or higher resolution. Those skilled in the art will appreciate that the figures are not drawn to scale and have been enlarged in order to illustrate the major aspects of the inkjet printhead 10.

Some inkjet printheads are made using thermally steered ink drop technology. As such, thermally steered inkjet printheads utilize thermal means to steer a continuous stream of ink drops ejected from each of a plurality of nozzle openings 26 in the inkjet printhead 10. Each of the nozzle openings 26 is also referred to as an "orifice" or a "bore" in the art. For thermal steering, ink-jet printhead 10 includes a plurality of upper heaters 28*a* and lower heaters 28*b* (also known as actuators), located about the nozzle openings 26 to permit thermal steering. Specifically, each pair of heaters 28*a*, 28*b* are predisposed about a single nozzle opening 26 for directing the flow of ink drops 34 through the nozzle openings 26. For simplicity, the terms "heater" and "heaters", "actuator" and "actuators", will be used interchangeably and to refer to the singular and plural form of the corresponding part. For reference, U.S. Pat. No. 6,079,821 describes the operation of such a thermally steered inkjet printing in detail. Commonly assigned U.S. application Ser. No. 09/607,840, filed in the name of Lee et al, describes the operation of thermally steered drop-on-demand inkjet printing.

Figure 2:
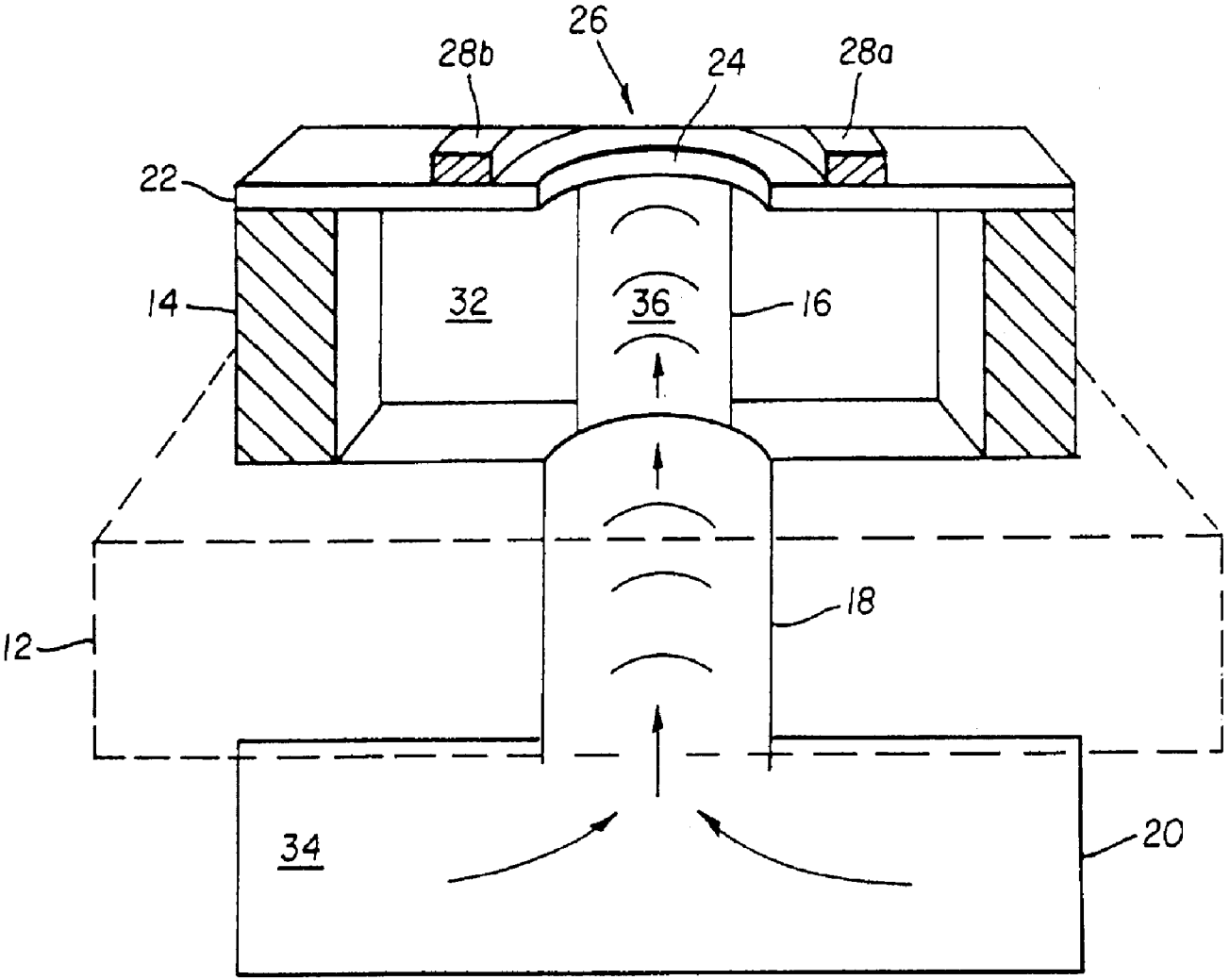
FIG. 2 illustrates a single printhead nozzle with two heater elements.

FIG. 2 is a cross-section view in perspective of a thermally steered inkjet printhead, such as printhead 10, illustrating the use of heaters 28*a*, 28*b*. Substrate 22 is attached to the gasket manifold 14 which, in turn, is bonded to the mounting block 12 in order to form the sub-assembly of inkjet printhead 10. The mounting block 12 and the gasket manifold 14 together form a delivery system wherein fluid flow channels 18 are defined. Each fluid flow channel 18 provides a route for the ink stream 36 to exit the nozzle 24 through openings 26. Predisposed about the nozzle opening 26 are heaters 28*a* and 28*b*, which are used to direct the flow of ink stream 36 through the nozzle opening 26 via thermal deflection.

Typically, heaters 28*a*, 28*b* are arranged in a split-ring fashion about a corresponding nozzle opening 26. That is, heaters 28*a*, 28*b* comprise an upper heater and a lower heater, respectively, that allow for thermal deflection of the ink stream 36 exiting the nozzle opening 26 onto a receiver medium, such as paper. Therefore, if an ink stream 36 directed to the upper direction is desired, the lower heater 28*b* is heated, causing the ink stream 36 to bend in the upper direction. If, however, an ink stream 36 directed to the lower direction is desired, then the upper heater 28*a* is heated, causing the ink stream 36 to bend to the lower direction.

A nozzle 24 comprises a nozzle cavity 32 for facilitating the flow of ink 34 from the reservoir 20. In operation, ink from the nozzle cavity 32 is ejected through the opening 26 and exits as an ink stream 36. At a distance removed from the printhead 10, the ink stream 36 breaks up into ink drops traveling in the same direction as the ink stream 36. Heat pulses applied to one or more heaters 28 cause the ink stream 36 to be directed in a printing direction or in a non-printing direction. Typically, ink is recycled from the non-printing direction using a gutter assembly (not shown) that directs the ink to a recycling unit (not shown). Thus, ink 34 travels from the ink reservoir 20 through the fluid flow channels 18 to the inlet/outlet tubes 16 in order to exit the nozzle openings 26.

The flow of ink through the nozzle opening 26 is facilitated by a print engine including a print data driver that drives each nozzle 24 in order to cause ink to flow through a nozzle opening 26 in the desired direction. The electronics utilized to achieve this function include data path and control electronics that are responsible for generating the print data and controlling the flow of print data from the print engine to the printhead. In the design of a printhead electrical interface, it is desired to minimize the number of signals and interconnections of the interface.

Figure 3:
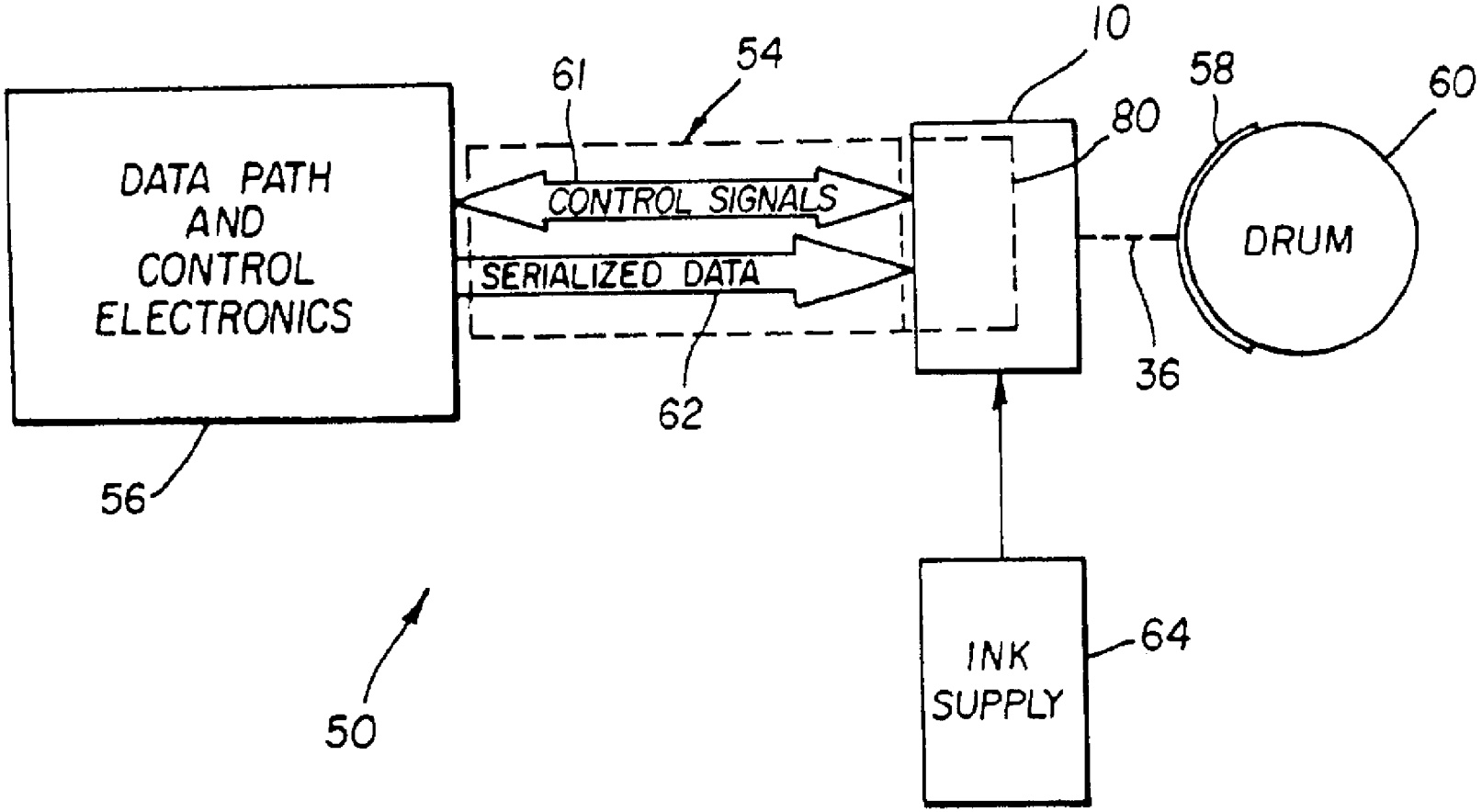
FIG. 3 is high-level block diagram of a thermal inkjet printhead assembly where data to the printhead is serialized.

FIG. 3 illustrates the use of data path and control electronics in a printer system 50 utilizing a thermal inkjet type printhead, such as printhead 10, where data serialization is applied. Printer system 50 includes a printhead 10 which utilizes two heater elements per nozzle (not shown in FIG. 3). The printhead 10 applies ink to media 58 mounted on a drum 60. In other configurations, the media may be mounted on a flatbed, and the printhead 10 positioned by way of a carriage to print onto the media 58. Ink is supplied to the printhead 10 from an ink supply system 64. The data path and control electronics 56 provides control signals 61 to the printhead 10 via interface 54.

As shown, interface 54 includes a serial DATA line 62 which carries serialized data to the printhead 10. The data is ported through a serial data shift register (discussed below) that restores the parallel nature of the data so that accurate printing is achieved. The data is routed so the assigned raster data is delivered to each of the heaters. Essentially, the data path and control electronics 56 ensures that while data for the next line of an image is being serially shifted down the serial shift register, current data for the line has been latched (saved) and is gated with an "enable" pulse to provide the correct amount of ink to be applied to the media being printed.

Physically, interface 54 includes a fiber optic cable installed within the printer system 50 as part of the printhead assembly. The interface 54 also includes the various logic circuits, signal paths and discrete devices, and other similar components. Depending on the design resolution of the printhead 10, such components can consume considerable real estate on the printhead assembly. Therefore, the present invention provides a printhead assembly that minimizes the number of interconnections between the data path and control electronics 56 and the printhead 10.

Figure 4:
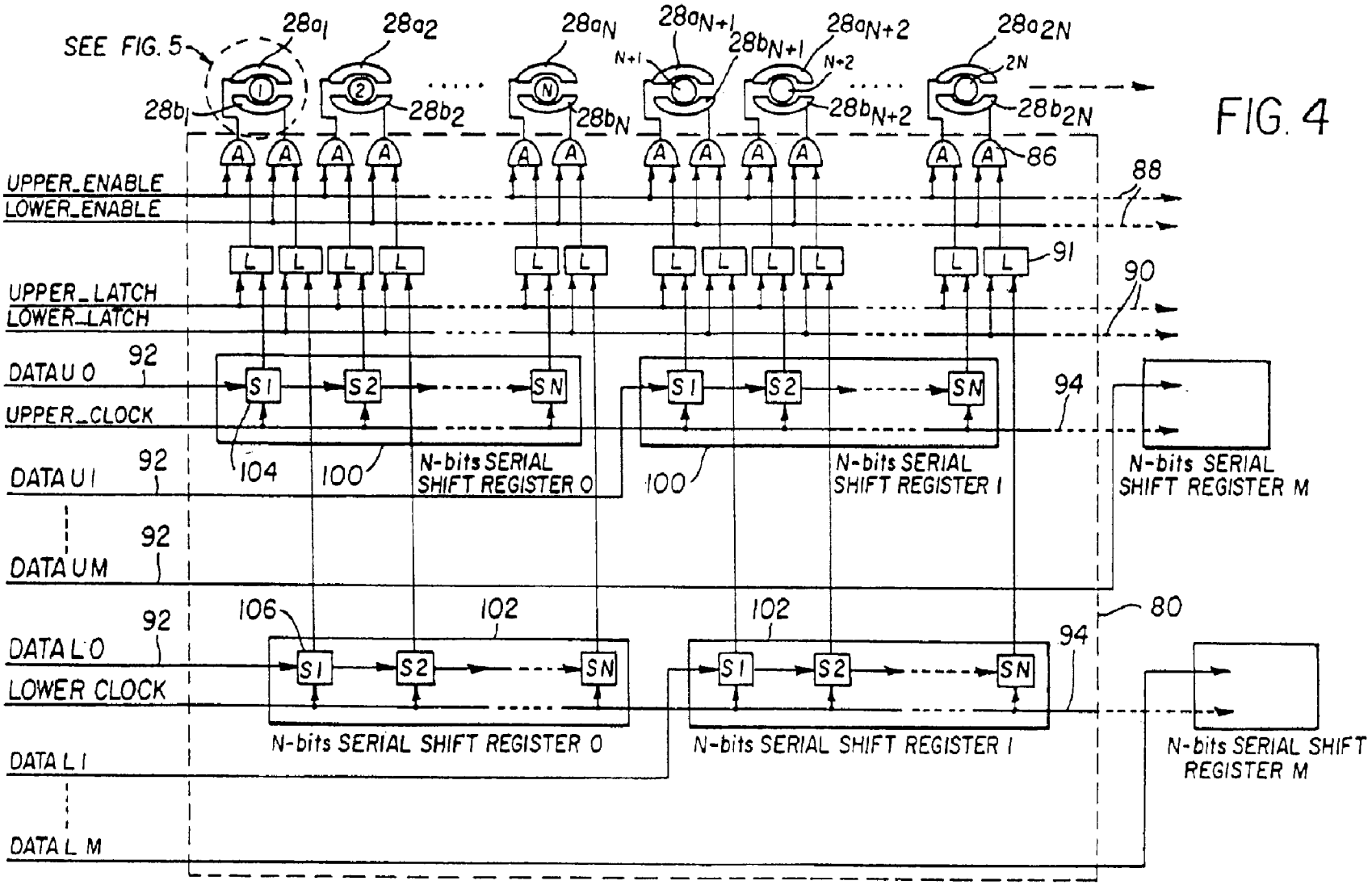
FIG. 4 is a detailed block diagram of the electrical interface within a printhead assembly using a serial shift register for driving nozzles in the printhead.

With reference now to FIG. 4, therein is shown a first embodiment of the invention, in the form of a block diagram of an interface 80 contained within the printhead 10. In essence, the interface 80 of the present invention uses serial shift registers to minimize the number of data lines required to drive the printhead 10. The interface 80 is configured to operate between the data path and control electronics 56 and the printhead 10 of the printhead assembly in which it is used. It should be understood that the interface 80 of FIG. 4 only shows a small number of circuits compared to what would be used in a more typical printhead supporting a larger number of printing nozzles.

As shown, each serial shift register 100 is composed of N shift register stages 104 connected in a serial fashion. Likewise, each serial shift register 102 is composed of N shift register stages 106 connected in a serial fashion. In the configuration shown, each serial shift register 100 of N shift register stages 104 supports data transfer to the upper nozzles, while each serial shift registers 102 with N shift register stages 106 supplies data for the lower heaters. Data is clocked through the shift registers 104, 106 upon the occurrence of a rising edge on the "CLOCK" line 94 with a separate clock line implemented for upper and lower heaters. When data has been loaded to all the elements in the serial shift register 100, 102, the Q outputs of the shift register stages 104, 106 are captured by use of latch registers 91 via LATCH lines 90. The latched data then serves to validate whether heat is applied to or not applied at a particular nozzle heater 28. The output 90*a* from the latch register 91 is gated using an AND logic element 86 with a pulse from an ENABLE line 88 and if a particular heater 28 is chosen for actuation, the latch output will be valid. The result of this AND operation is then used to switch on the nozzle heater driver 84 (FIG. 5), thus allowing the particular heater element to be biased with the heater power source.

In an actual printhead, the length of the N-bit serial shift registers 100, 102 is likely to be 32, 64, 128, 256, or 512 bits. The length of the N-bit serial shift register 100, 102 has a significant impact on the speed of access to an individual heater 28. As previously explained, all N bits in the shift registers 100, 102 must be loaded before the LATCH lines 90 can be actuated to transfer the contents of the shift registers into the latch registers 91. The period of time required to load an N-bit serial shift register limits how rapidly an individual heater can be addressed which, in turn, limits how rapidly a heater can be turned ON and then OFF. The minimum time required to address a heater is a function of the frequency of the clock signal on the CLOCK line 94 and the number, N, of shift register stages 104, 106 contained within the N-bit serial shift register 100 or 102. This relationship is governed by Equation 1 as follows:

$$\text{Minimum Heater Address Time}=(1/\text{freq}_{clock})*N \qquad \text{Equ. 1}$$

The upper limit in the choice of a clock frequency is often constrained by the speed of the shift register circuitry. To optimize the heater address time, the serial shift register, 100 or 102, should contain fewer shift register stages 104 or 106, to minimize the value of N. However, for a fixed number of nozzles in the printhead, if N is small there will be a larger number of serial shift registers 100 and 102. In a conventional printhead design, each additional serial shift register requires an additional DATA line 92 and a corresponding additional electrical interconnection to the printhead. A large number of N-bit serial shift registers 100 and 102 will require a large number of electrical interconnections to the printhead, which can be costly or physically incompatible with the desire to manufacture small printheads.

Thus, a design conflict exists between minimizing heater address time and minimizing the number of interconnects to the printhead. To minimize the number of DATA lines 92 to the printhead, the number of shift register stages, N, in the N-bit serial shift registers 100, 102 would be maximized. However, a large value of N significantly increases the time to address an individual heater and may not be compatible with the fluids in use as well as the printing rates desired. Therefore, the present invention provides additional embodiments and methods of reducing the number of interconnects in the printhead assembly that take into account the heater address time.

Figure 5:
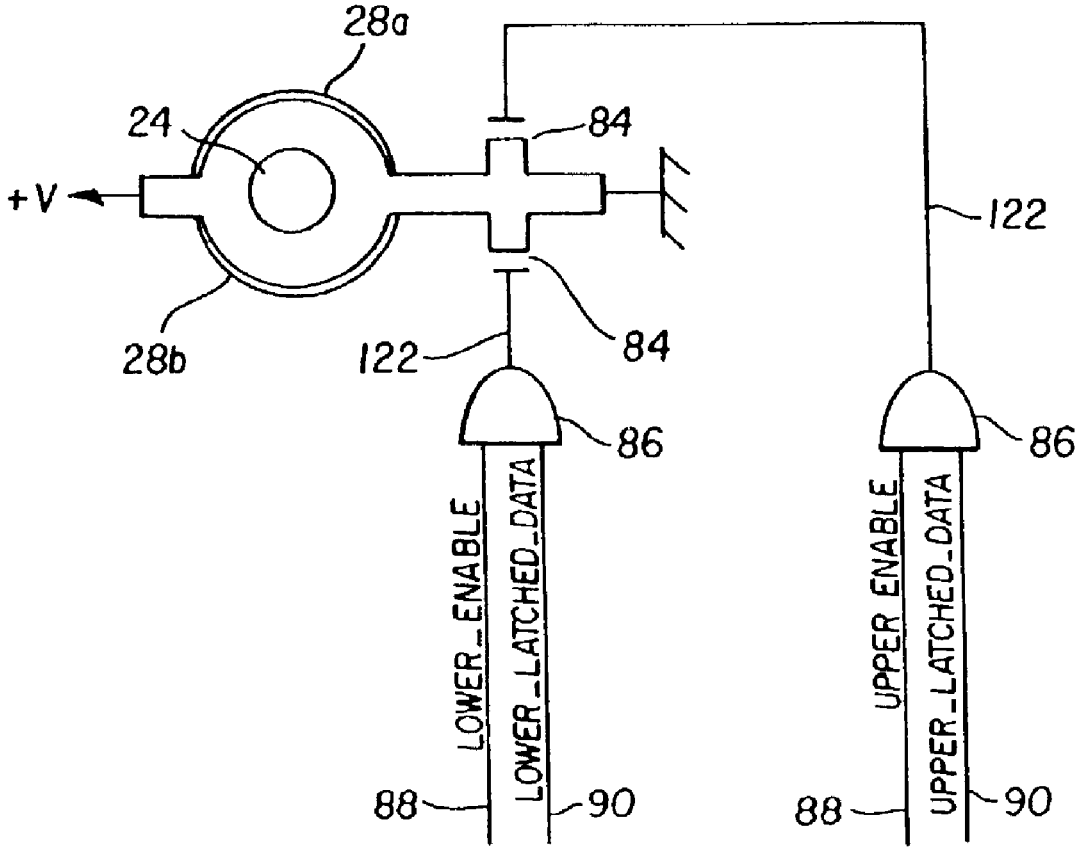
FIG. 5 is a circuit diagram of the interconnection between the nozzle heaters and the nozzle drivers.

With reference to FIG. 5, therein is shown the details of the nozzle heaters 28, which will guide in understanding the additional embodiment of the invention. Heaters 28*a*, 28*b* are located at the opposing sides of a printhead nozzle 24. An ENABLE line 88 and LATCHED_DATA line 90*a* are ANDED together at AND gate 86. The output 122 of the AND gate 86 provides a signal to a heater driver 84 which applies power to either upper heater 28*a* or lower heater 28*b*, as appropriate. In this example, either one of the two heaters 28*a* or 28*b* associated with a nozzle 24, is capable of actuating the nozzle. Applying power to either the upper heater 28*a* or the lower heater 28*b* will cause the ink droplet stream to deflect away from the energized heater.

Figure 6:
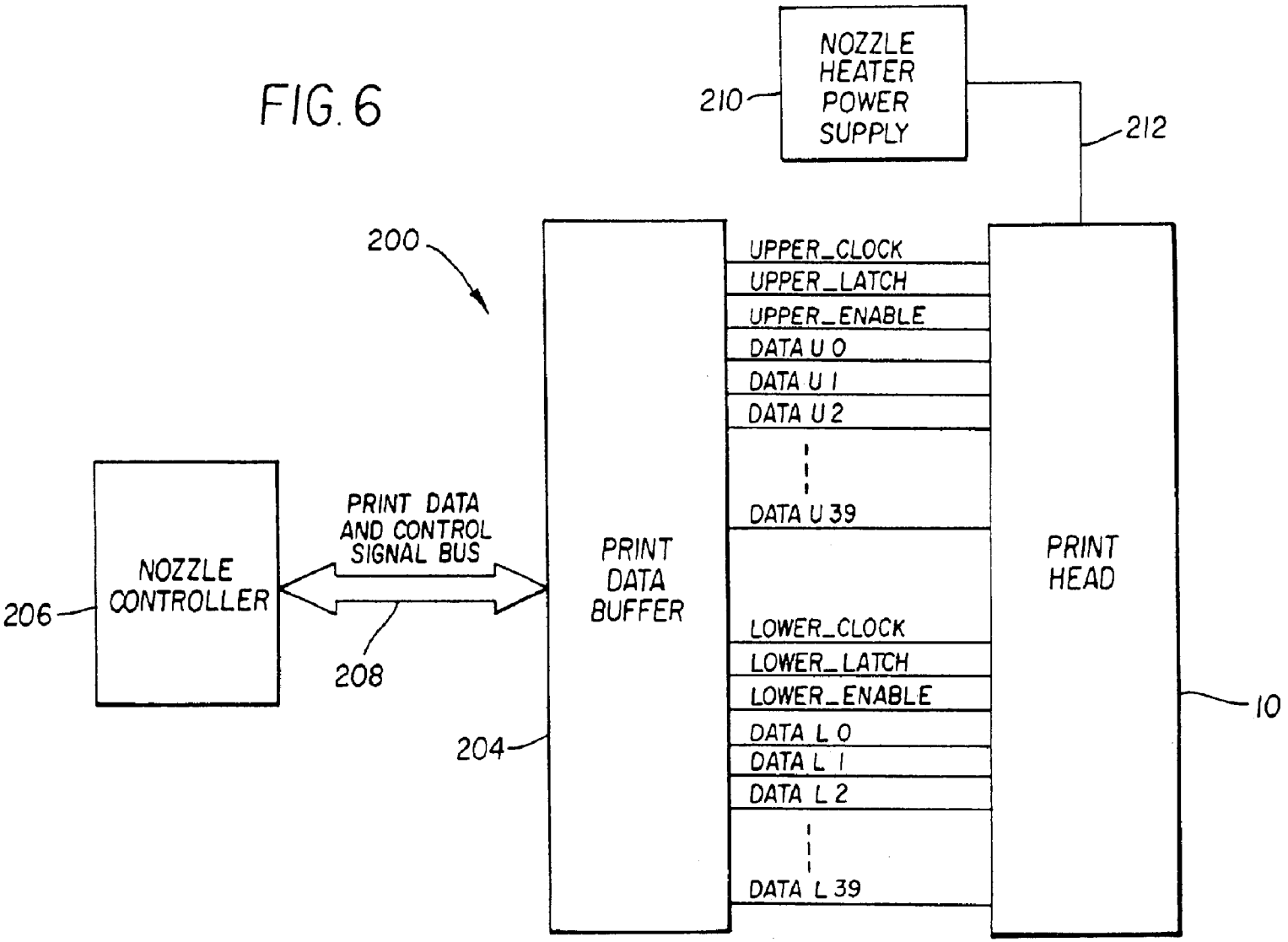
FIG. 6 is a block diagram of the interconnection of the printing system to the printhead.

With reference now to FIG. 6, therein is shown a printhead assembly, denoted generally as 200, with interconnections between the print data buffer 204 and the printhead 10. The nozzle controller 206 processes the image path data to be compatible with the printhead 10 and provides the control signals necessary to operate the printhead 10. The nozzle controller 206 also transfers the data and control signals via the print-data-and-control-signal bus 208 to the print data buffer 204 which provides a buffer function for all of the signals to the printhead 10. The nozzle heater power supply 210 provides power to the printhead via power line 212.

FIGS. 7, 8, 9, 10 and 11 are general block diagrams of respective different data shift register structure for a large printhead, such as printhead 10, incorporating a significant number of heaters. For simplicity, the data output lines to the respective latching registers from each shift register stage, the CLOCK 94, LATCH 90, and ENABLE lines 88 have been omitted in each Figure. For the example of FIG. 7, there are 40 upper 32-bit serial shift registers 100 and 40 lower 32-bit serial shift registers 102. Each 32-bit serial shift register 100 and 102 has a corresponding data input, DATAL0–DATAU39 and DATAL0–DATAL39, respectively. Thus, there are 80 DATA lines 92 to the printhead.

Figure 7:
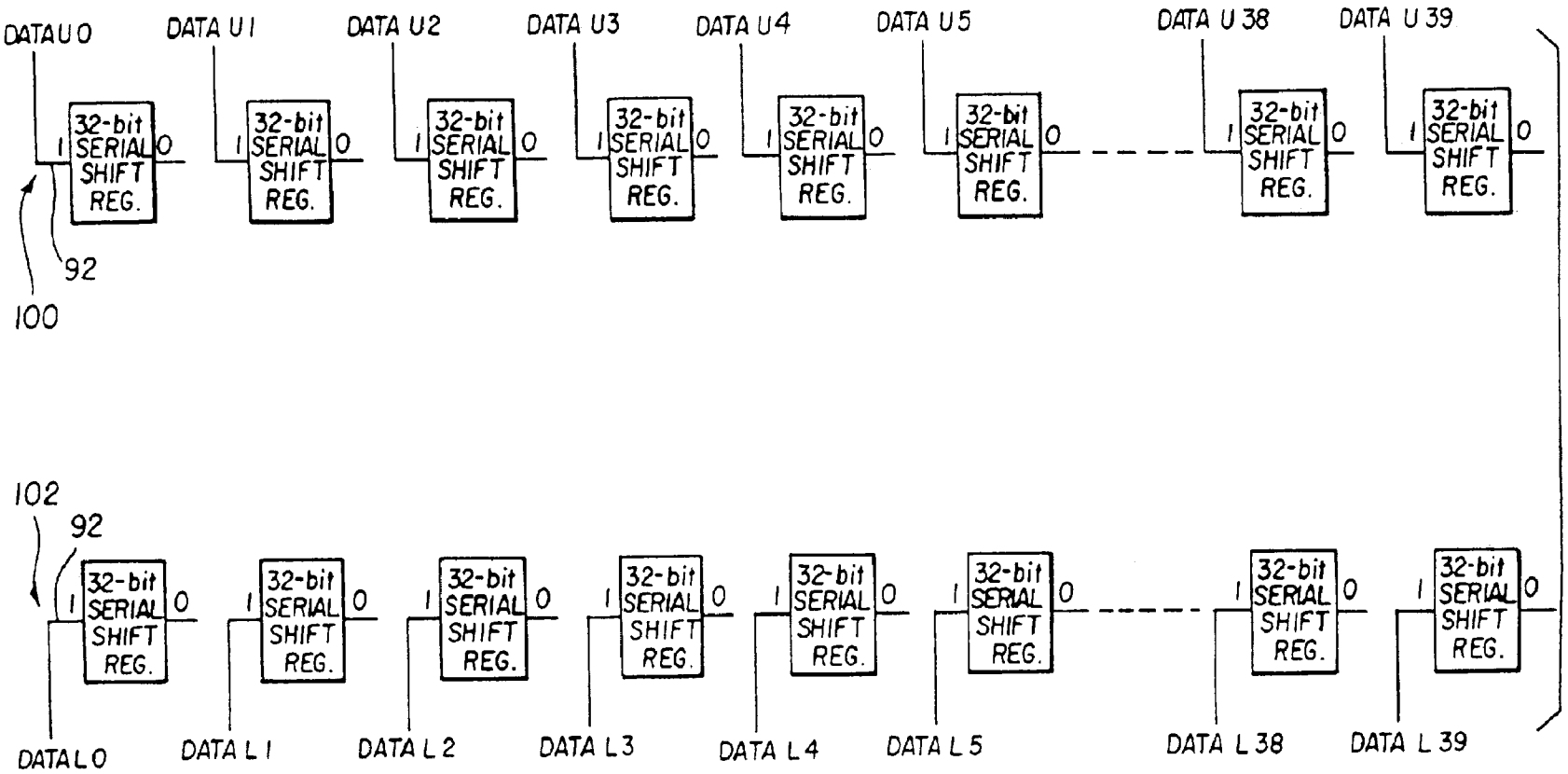
FIG. 7 is a block diagram of a serial shift register configuration in a thermally steered inkjet printhead.
Figure 8:
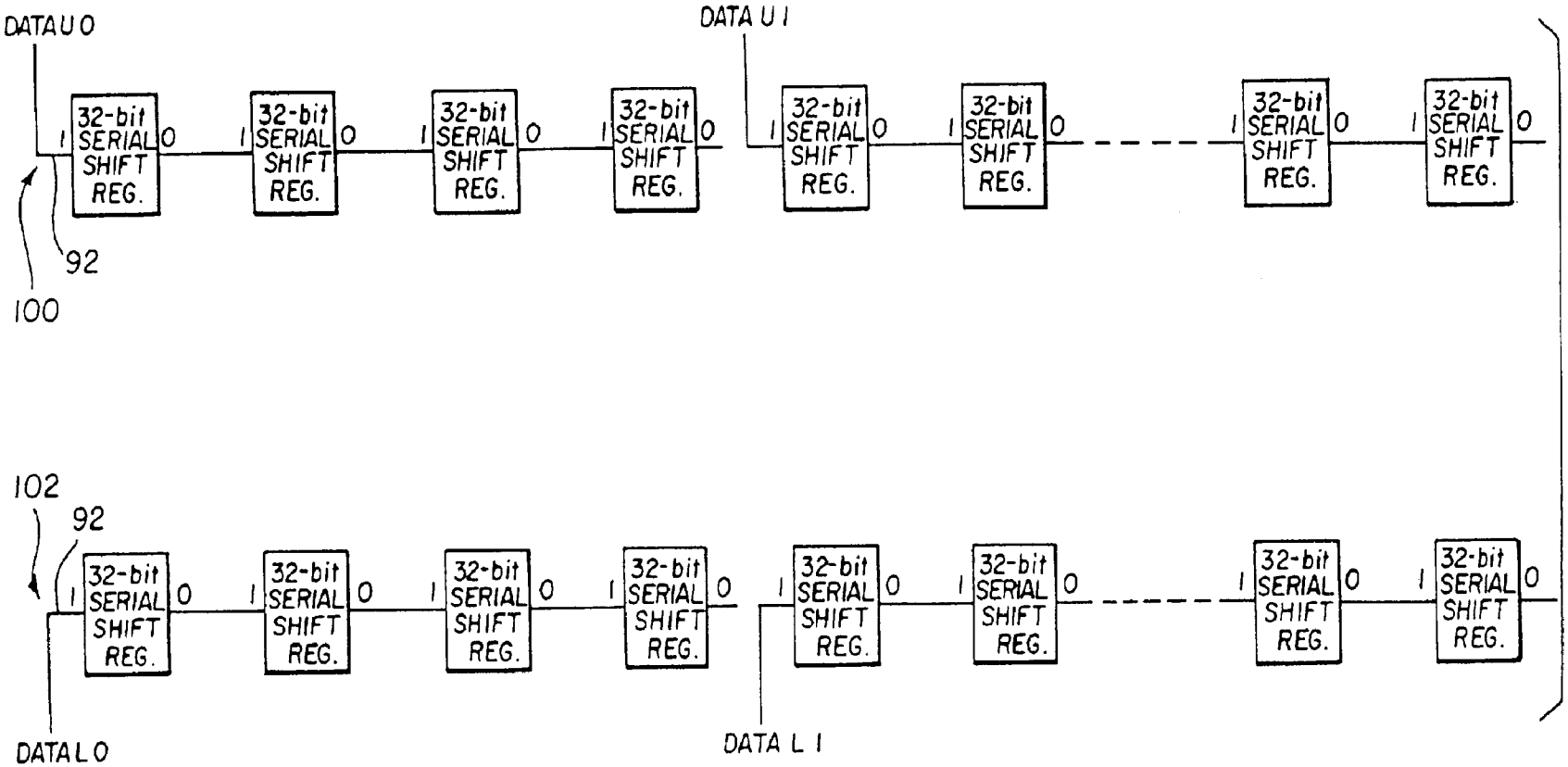
FIG. 8 is a block diagram of the data serial shift register configuration of a printhead.

FIG. 8 is a block diagram of an interconnection scheme for a large printhead with a significant number of heaters. As in FIG. 7, 80 of the 32-bit serial shift registers are shown, however, the data structure has been reconfigured to decrease the number of DATA lines 92 by a factor of 4. Specifically, FIG. 8 shows 4 of the 32-bit shift registers serially connected to form a larger 128-bit serial shift register. Only 20 DATA lines 92 are required for this configuration, compared to 80 DATA lines 92 for FIG. 7. To maintain the same heater address time as in FIG. 7, the frequency of the clock would need to be increased by a factor of 4 since the number of shift register stages in the larger serial shift register has increased from N=32 to N=128. However, there may be physical barriers which prevent the implementation of this architecture. Nevertheless, it is well known that large printheads are often constructed of small devices 108 which are used as modular building blocks for large printheads.

Figure 9:
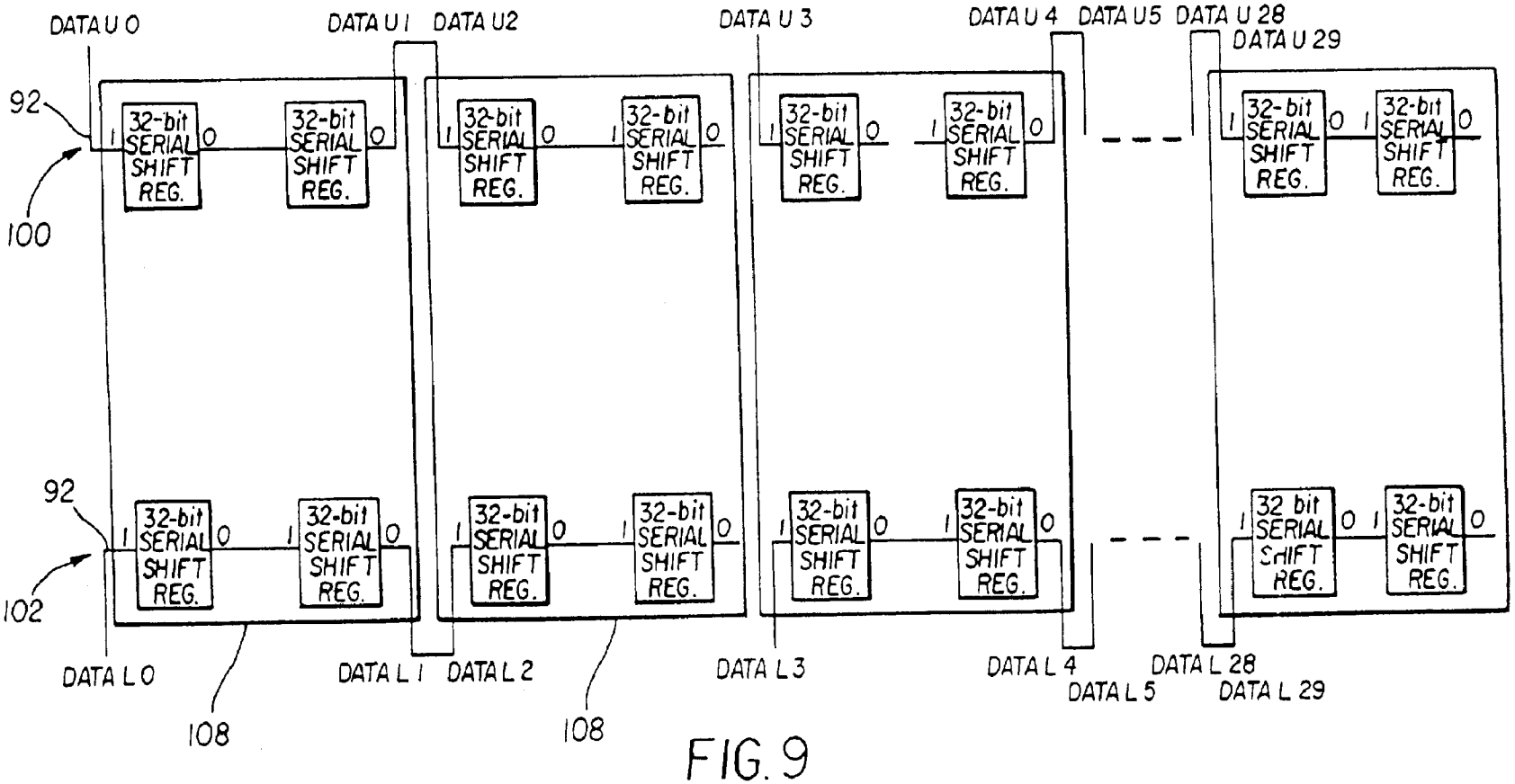
FIG. 9 is a block diagram of the data serial shift registers in a printhead configured with small devices.

FIG. 9 is a block diagram of an interconnection scheme for a large printhead constructed with small devices 108. In this example, each small device 108 contains two 32-bit serial shift registers for the upper serial shift register 100 and two 32-bit serial shift registers for the lower serial shift register 102. Each small device 108 also contains 64 nozzles 24 and the associated 64 upper heaters 28*a* and 64 lower heaters 28*b*. The small devices 108 provide an opportunity to build printheads in a modular fashion, providing flexibility in the size of the printhead.

As shown, the inputs (I) and outputs (O) of the serial shift register stages 100 and 102 allow the user to configure the printhead in a manner similar to FIG. 8. However, because the interconnection of the serial shift registers of different small devices 108 would require additional connections to the printhead, the additional connections to the printhead would reduce the advantage of using long shift registers. The example printhead of FIG. 9 would require 60 DATA lines 92. Some of these DATA lines 92 are jumpers from one small device 108 to the next small device 108, which accounts for two DATA lines 92. For small devices 108 containing more than two 32-bit registers for the upper serial shift register 100 and more than two 32-bit shift registers for the lower serial shift register 102, the interconnection scheme shown in FIG. 9 would produce a proportionately greater reduction in interconnections to the printhead as to the connection scheme of FIG. 7.

Figure 10:
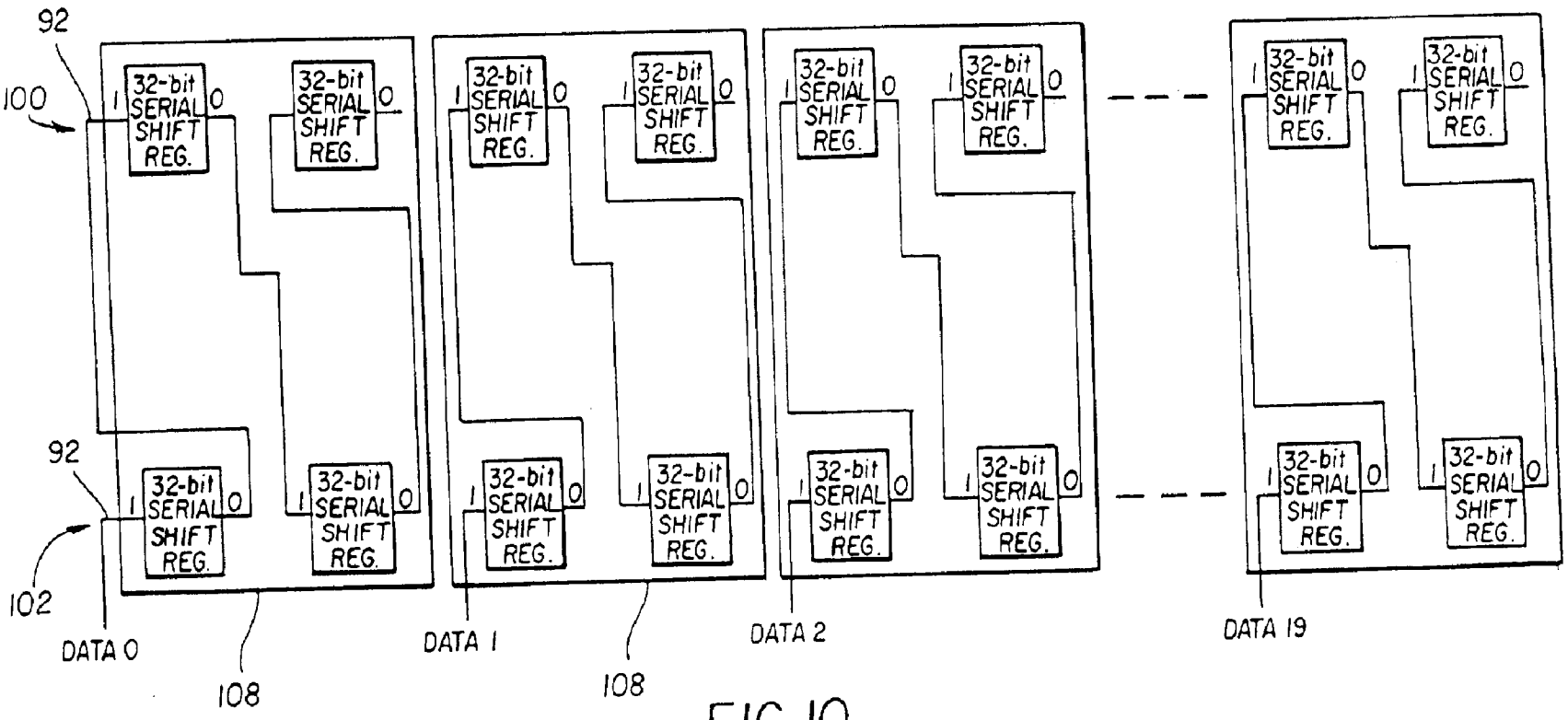
FIG. 10 is a block diagram of the data serial shift registers in a printhead configured with small devices which uses the second embodiment of the invention.

FIG. 10 is a block diagram of an interconnection scheme for a large printhead constructed with modular small devices 108. Because of the use of the small device 108, the printhead could be built in a modular fashion. In the embodiment of FIG. 10, the 32-bit shift registers in the lower serial shift register 102 are connected in serial fashion with the 32-bit shift registers in the upper serial shift register 100. By serially connecting the 4 shift registers within the small device 108, the length of the shift register is again 128-bits as it was in FIG. 9, however, this embodiment provides a significant reduction in interconnections to the printhead. For this example, 20 DATA lines 92 would be required to interconnect to the printhead. The seemingly simple approach shown in FIG. 10 is not obvious because the shift registers constructed in this manner contain different types of data, some for upper heaters and some for lower heaters. In addition, the information in the serial data for upper heater associated with nozzle 1 is separated by 32-bits from the data associated with the lower heater associated with nozzle 1. The creation of this serial bit stream requires that the data associated with a given nozzle (upper heater and lower heater) be separated by the number of bits in the small serial shift registers (32-bits in this example). This can be accomplished by buffering and/or providing controlled delays or selection counters.

The embodiment shown in FIG. 10 shows that the upper and lower serial shift registers are serially connected to form a single serial shift register which is used to address the upper and lower heaters 28*a* and 28*b*, respectively. Since there is only one serial shift register in the configuration of FIG. 10 (as opposed to two serial shift registers as shown in FIG. 4, FIG. 6 and FIG. 7), the number of clock lines and latch lines can also be reduced. In FIGS. 4, 6, and 7, two clock lines are required, UPPER_CLOCK 94 and LOWER_CLOCK 94. In the embodiment of FIG. 10, there is a single serial shift register common to both the upper and lower heaters 28*a*, 28*b*, such that the serial shift register can be driven with a single CLOCK line 94. Thus, the present inventions provides an interconnection mechanism that eliminated the requirement of separate LATCH lines for each serial shift register used in the printhead assembly so that a single serial shift register common to upper and lower heaters can be driven with a single LATCH line 90. In this way, the embodiment of FIG. 10 saves an additional two interconnections to the printhead by eliminating separate clock and latch connections.

Figure 11:
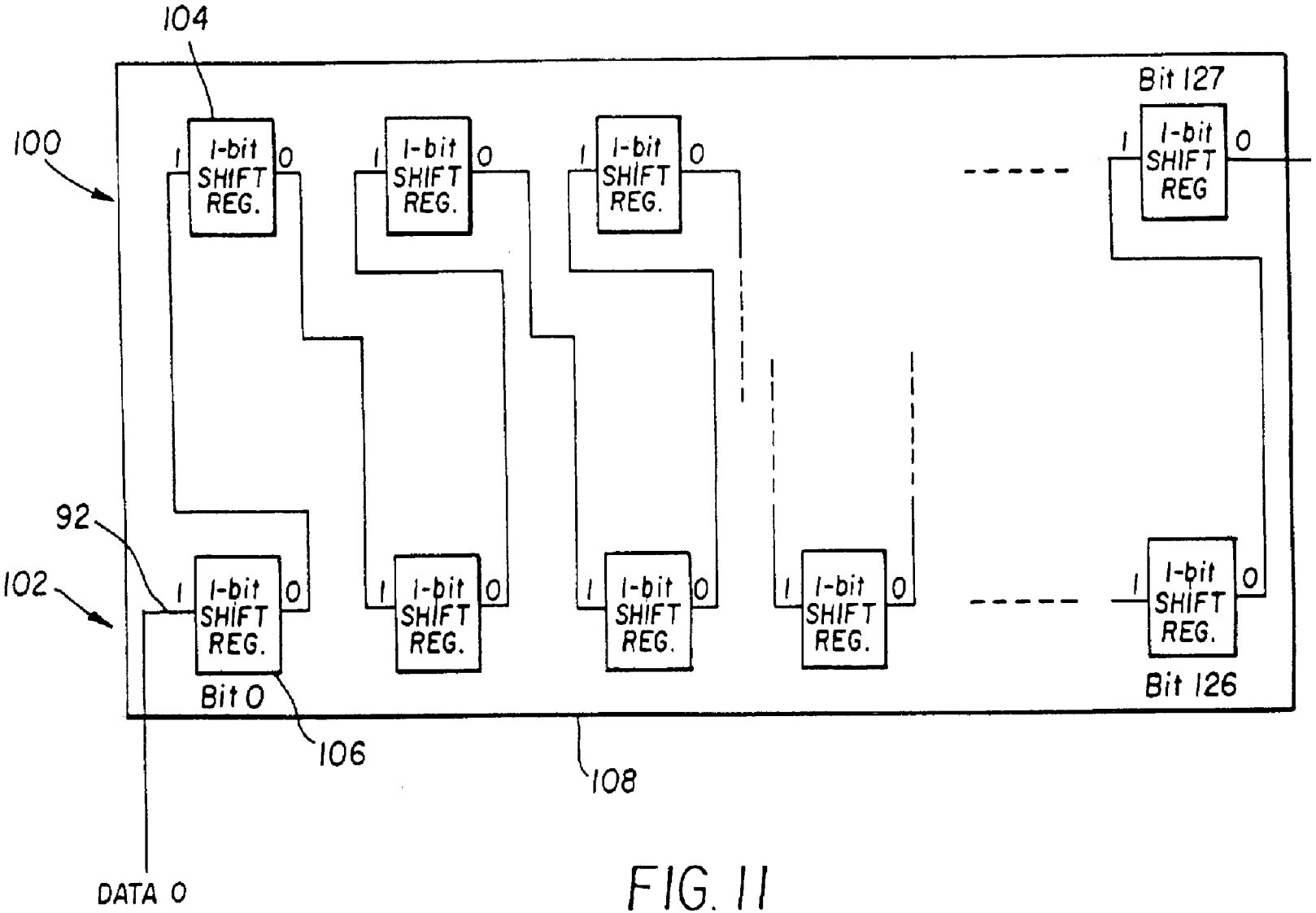
FIG. 11 is a block diagram of the data serial shift registers in a printhead configured with small devices which uses the third embodiment of the invention.

With reference now to FIG. 11, there is shown a third embodiment interconnection scheme that minimizes interconnections in the printhead assembly according to the invention. Specifically, as shown in FIG. 10, there is required a 32 bit separation of the two data bits (associated with the two heaters 28*a*, 28*b* at a given nozzle 24) in the serial data stream. In contrast, FIG. 11 shows an interconnection of the upper serial shift register 100 and the lower serial shift register 102 where adjacent shift register stages 104, 106 in the combined shift register represent two heaters 28*a*, 28*b* associated with one nozzle 24. The output of a lower shift register stage 106 is connected to input of the upper shift register stage 104 while the output of the upper shift register stage 104 is connected to the input of the lower shift register stage 106, resulting in an alternating interconnection scheme. This alternating interconnection of the upper shift register stages 104 and lower shift register stage 106 allows the data bits associated with the two heaters 28*a*, 28*b* (associated with a particular nozzle 24) to be adjacent to each other in the data stream, rather than being separated by 32 bits, as was the case in FIG. 10.

The creation of adjacent data bits in the data stream associated with the two heaters 28*a*, 28*b* for a given nozzle is much easier and simplifies the circuitry utilized to create the data stream. In this example all 4 of the 32-bit serial shift registers would be interleaved in the fashion described above, so the complete length of the shift register would be 128 bits. The 128-bit shift register would have one DATA line 92 input from outside the small device 108. FIG. 11 shows that the interconnection scheme can be used to connect the shift register stages 104, 106 within one small device 108 in a modular printhead. Thus, the embodiment of FIG. 11 also minimizes the number of DATA lines 92 to a total of 20 for the printhead heater configuration originally described in FIG. 9.

The embodiment shown in FIG. 11 shows the upper and lower shift registers as serially connected to form a single serial shift register which is used to address the upper and lower heaters 28*a* and 28*b*, respectively, with respective outputs from respective shift register stages. Since there is only one serial shift register in the interconnection scheme of FIG. 11 (compared to two serial shift registers in the interconnection schemes of FIGS. 4, 6 and 7), the total number of CLOCK lines and LATCH lines is reduced. In FIGS. 4, 6, FIG. 7, two clock lines are required, UPPER_CLOCK 94 and LOWER_CLOCK 94. In the embodiment of FIG. 11, there is a single serial shift register common to the upper 28*a* and lower heaters 28*b* which can be driven with a single CLOCK line. In this way, the embodiment of FIG. 11 further reduces the number of interconnections of the printhead assembly and eliminates unnecessary clock and latch connections.

Table 1 shows the number of interconnects required for the various interconnections schemes of the invention (the interconnects required for the ENABLE signals 88 are not included in the table).

TABLE 1

Total number of interconnects for each embodiment of the invention.

| INTERCONNECT OBJECTIVE | FIG. | DATA | CLOCK | LATCH | TOTAL INTER-CONNECTS |
|---|---|---|---|---|---|
| Maximum Address Speed | 7 | 80 | 2 | 2 | 84 |
| Continuous Head Reduction | 8 | 20 | 2 | 2 | 24 |
| Modular Head Reduction | 9 | 60 | 2 | 2 | 64 |
| Modular Head Embodiment 2 | 10 | 20 | 1 | 1 | 22 |
| Modular Head Embodiment 3 | 11 | 20 | 1 | 1 | 22 |

Figure 12:
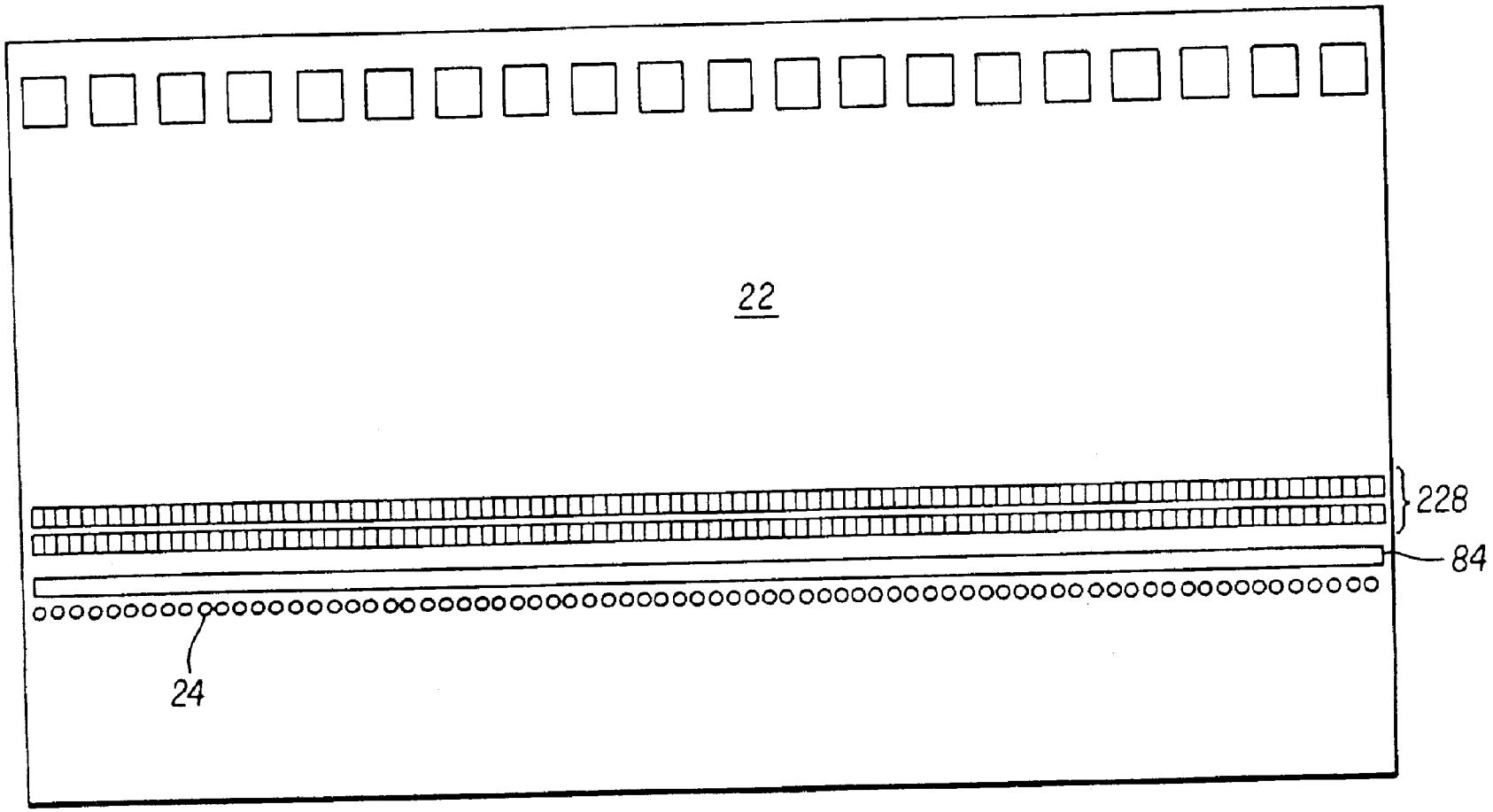
FIG. 12 is a top plan view schematic of printhead 10.

With reference now to FIG. 12, therein is shown a top-down view of the inkjet printhead 10 arranged so that nozzles 24 and shift register stages 228 facilitate cleaning of the printhead 10 according to the invention. The printhead 10 comprises a plurality of nozzles 24 arranged in a straight line across the printing length of the printhead 10. This forms an array for ejecting ink to form an image on a receiver member crossing nozzles 10.

Figure 13:
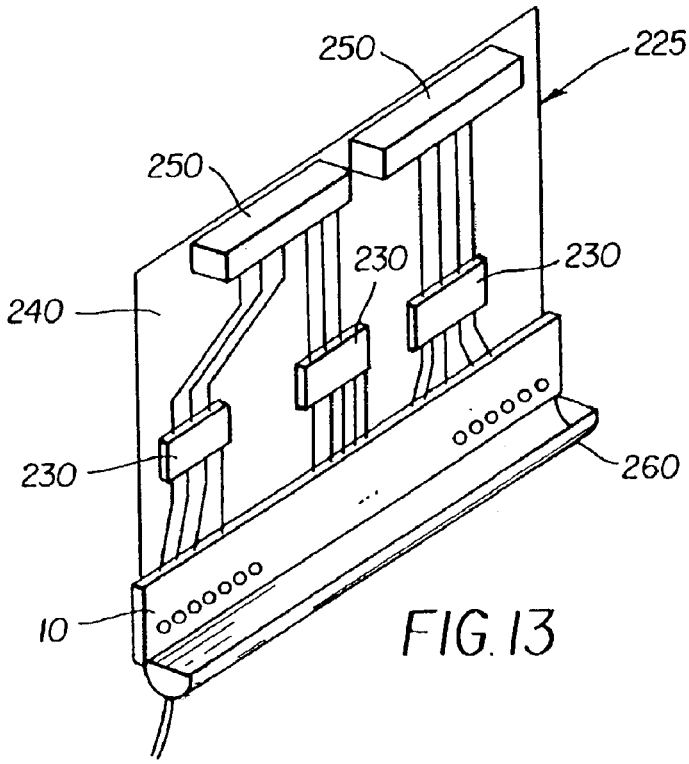
FIG. 13 shows a printhead assembly in perspective with the components arranged such that optimum cleaning and maintenance of the printhead is promoted.
Figure 14:
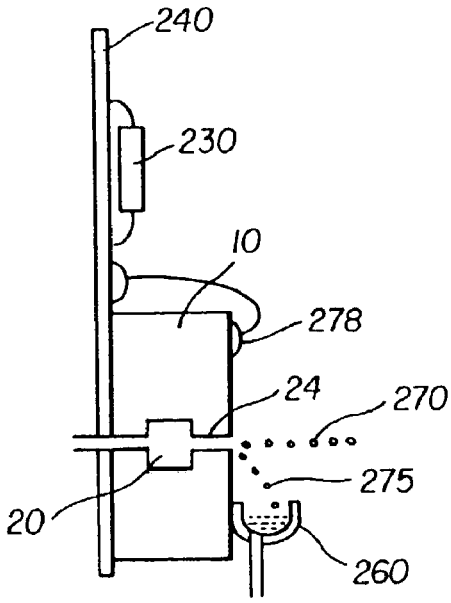
FIG. 14 is a side view in schematic that illustrates the flow of ink droplets with respect to the printhead assembly shown in FIG. 13.

A plurality of actuators in the form heat drivers 84, are provided such that each actuator 84 is associated with each respective nozzle 24. For simplicity, the terms "actuator" and "heat drivers" shall be referred to interchangeably. Preferably, each actuator 84 is separately drivable to affect ejection of ink from the respective nozzle 24. The plurality of data shift registers stages, denoted here as 228, are then arranged such that each stage 228 is associated with a respective nozzle actuator 84 and nozzle actuators 84, in turn, are associated with each nozzle heater element (either upper 28*a* or lower heater element 28*b*) and with different shift register stages 228. The shift register stages 228 are adapted to shift data from one stage to a next stage to distribute data to the different stages 228. Cleaning of the printhead 10 is provided by the positioning of the shift register stages 228 and their electrical interconnections using wire-bonding to bond pads 278 which are positioned on the same side of the printhead 10 substrate 22 such that enough room is provided for a cleaning mechanism (not shown) to reach the nozzles 24 and not cause damage to the shift register circuits on the printhead. FIG. 14 illustrates the position of the bond pads and wirebonds (278). The fact that shift register stages 228 are arranged on the same side as opposed to other areas of the printhead 10, means that a space is provided for cleaning of the printhead 10 using well known cleaning techniques such as, for example, by using a brush, wiper, sprayer, vacuum suction device, and/or spitting of ink through the plurality of nozzles 24. FIG. 13 shows an implementation of a printhead assembly 225 utilizing this shift register arrangement to promote printhead cleaning.

The assembly 225 shown in FIG. 13 shows that with this shift register arrangement, the external electrical parts are located up and away from the area of exposure to the ink droplet streams 270 and 275 shown in FIG. 14. These components include electrical circuits 230 that are part of electrical interface 54 that are external to the printhead. The circuit board 240 upon which the printhead 10, and external electrical circuits 230 are located is also the site for cable connections 250 to bring in external data and control signals to the printhead assembly 225. For applications using continuous inkjet actuators, this arrangement of electronics lends itself to the implementation of a gutter 260 to collect ink droplet streams during periods when there is no data to be written to media. Inkjet droplet stream 270 is directed to deposit on recording media for recording an image, while stream 275 is directed to be recycled using gutter 260 to collect the ink droplets.

Figure 16:
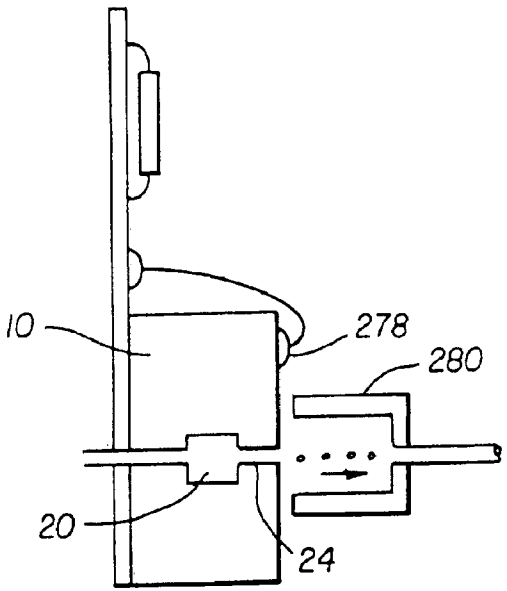
FIG. 16 is a side view in schematic that illustrates the printhead with an arrangement of electronics and printhead components to promote optimum cleaning when parked at the cleaning station.
Figure 15:
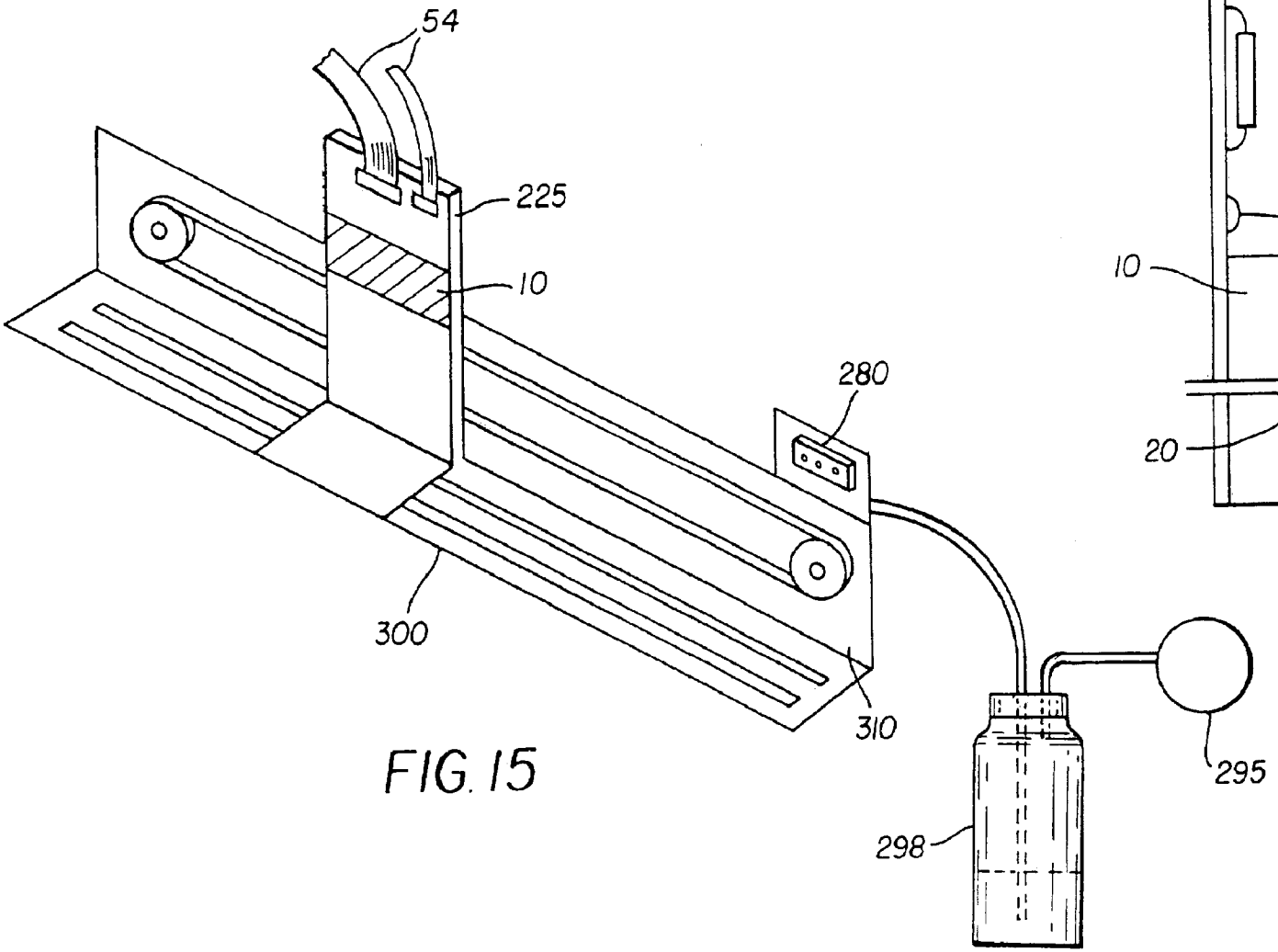
FIG. 15 is a schematic illustration in perspective of the printhead assembly of FIG. 12 installed on a printer carriage with a printhead cleaning station implemented as part of the printer.

FIG. 15 illustrates a typical printer arrangement 300 utilizing a carriage assembly 310. The printhead assembly 225 is mounted upon the carriage assembly 310 which includes, for example, rails upon which the printhead assembly 225 is mounted for movement. Alternatively, the cleaning assembly may be moved to position itself in position for cleaning of the printhead. When it is desired to clean the printhead 10, the printer's control system will position the printhead assembly 225 to face the cleaning station 280 to proceed with the cleaning of the print head. In this implementation, a vacuum cleaning system is shown. FIG. 16 shows the printhead parked at the cleaning station 280, such that a rubber or other material shroud provides a vacuum tight enclosure about printhead 10. Using the force of the vacuum, inkjet droplets that are located in the nozzle or on the outside surface of the nozzle are drawn into a collection vessel 298. The vacuum is provided by vacuum pump 295. Other forms of cleaning devices including blades, brushes, etc. may also be used. With the use of blades, it usually is desirable to provide the surface of the printhead with a planar surface. In the embodiment of FIG. 1, a passivation layer may be provided over substrate 22 to cover the heater elements 28*a*, 28*b* and provide a planar surface to the printhead with openings for the nozzle openings. Preferably, the placement of the bond pads 278 on the printhead that are electrically connected to the shift registers near the nozzle will be at least 2 to 3 mm spacing from the nozzle openings to provide clearance for movement of the printhead assembly relative to the cleaning station and for positioning of the printhead assembly at the cleaning station.

Figure 17:
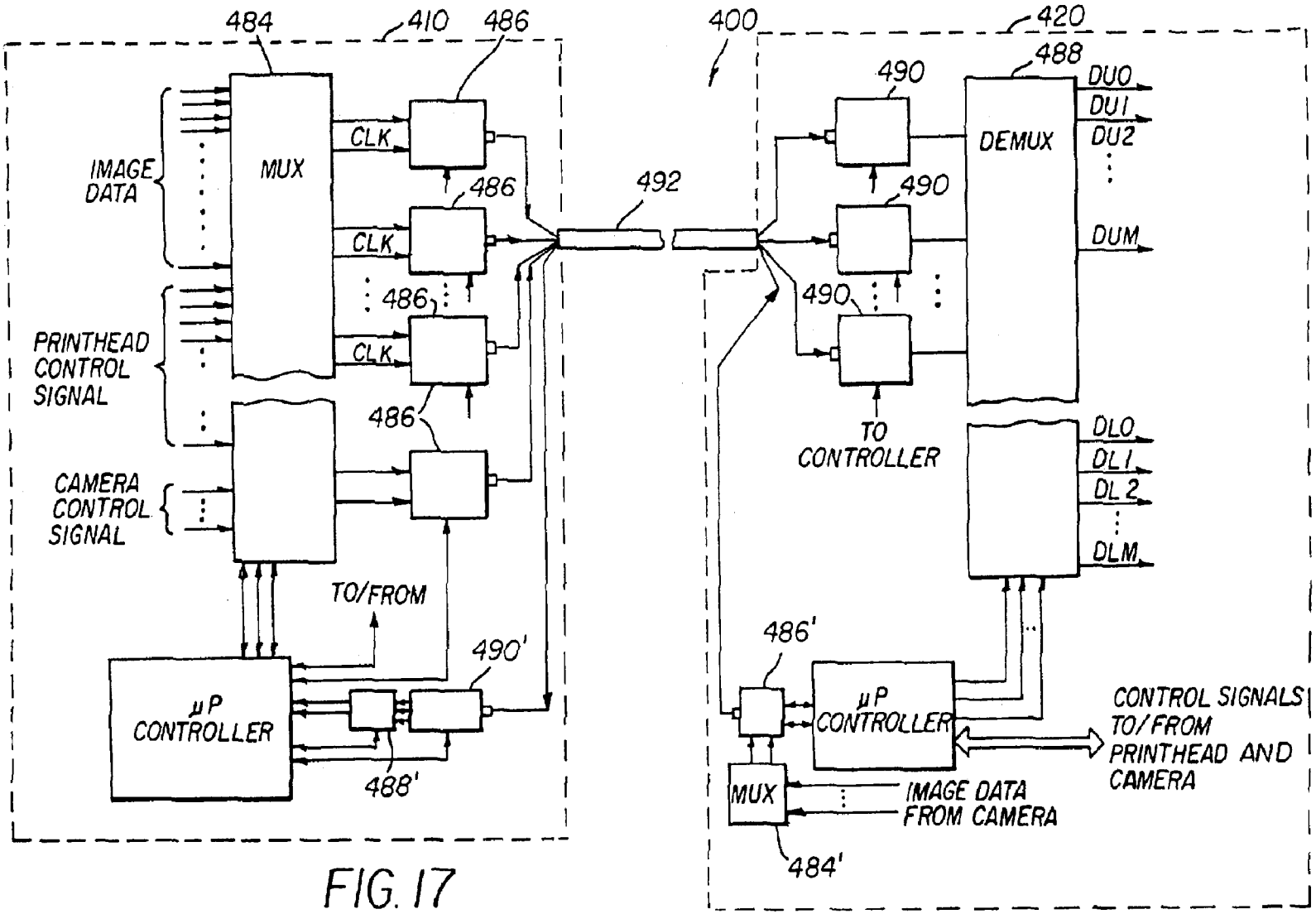
FIG. 17 is a detailed block diagram of a time division multiplexed fiber optic interface within a printhead assembly and also the data path and control electronics assembly.

With reference now to FIG. 17 there is shown an embodiment of the invention in the form of a block diagram of a fiber optic multiplexing-demultiplexing interface 400 for handling image data. The illustration there shown is for a one color inkjet printer it being understood that there would be additional circuits provided for supporting of the colors and the signals necessary for them. In this regard, reference is made to U.S. application Ser. No. 09/662,253, filed Sep. 14, 2000 in the name of Szumla et al., the pertinent contents of which showing multiple color image planes are incorporated herein by reference. Multiplexing circuit 410 is contained within the data path and control electronics 56 of each color processing circuit. Also shown is a fiber optic demultiplexing circuit 420 on printhead assembly 225, forming a part of interface 80 shown in FIG. 3. This implementation of the fiber optic link between data path and control circuits and the printhead is shown using the time division multiplexing technique. This technique utilizes a high-speed clock, and each clock period is allocated to sampling one of the input signal lines of the multiple input lines forming a part of input multiplexer 484. The clock period is selected such that the time interval in-between samplings is non-critical to the signal's fidelity. In other words the fact that the signal's change in state or value is not reported until its allocated time slot is required to be tolerable in the application. Thus, the high frequency operation of the multiplexer-demultiplexer circuitry, with clock rates of say 672 MHz all larger, is significantly higher than the clock rates for shifting data through the shift registers so that essentially image data signals incoming to the shift registers arrive substantially simultaneously in parallel This example embodiment is using the LVDS signal format and multiplexing components developed by the National Semiconductor (item 484) (National Semi part number DS90CR483). The multiplexed electrical signals output from 484 are then converted to light energy by component 486, optical transmitter OPT2325. The light energy form of the signals are then transmitted to the print head assembly via fiber cable item 492. Utilizing a fiber optic cable solution, the equivalent number of signals required now only need 16 fiber optic channels for a single color inkjet printhead having 1000 nozzles of say a three inch wide printhead. Of course multiplexers-demultiplexers may be used that have greater capacity in which case fewer fiber optic channels may be required. Even with 16 fibers bundled into one cable the cable may have a cross sectional area of only 0.25 inches. FIG. 17 only shows a small number of circuits compared to what would be used in a more typical printhead supporting a larger number of printing nozzles and colors. At the printhead assembly, the light energy form of the signals are returned to electrical form by optical receiver 490 (part OPT1265 from Optocom) and demultiplexed by demultiplexer circuit 488 (National Semiconductor part DS90CR484) to the signal's original discrete form. This example can also be realized using the Fibre Channel technology offered by the Motorola Corporation or other equivalent technique. Suitable microprocessor based controllers on the multiplexer circuit 410 and in the than the demultiplexer circuit 420 may also be provided and are illustrated, however it is known that controllers are incorporated on the multiplexer or demultiplexer chips themselves and such are preferred. The multiplexed signals are then input to the data inputs of the shift registers 102. Additionally, control signals for the shift registers may also be subject to transmission via a multiplexer fiber optic channel-demultiplexer transmission path.

Figure 18:
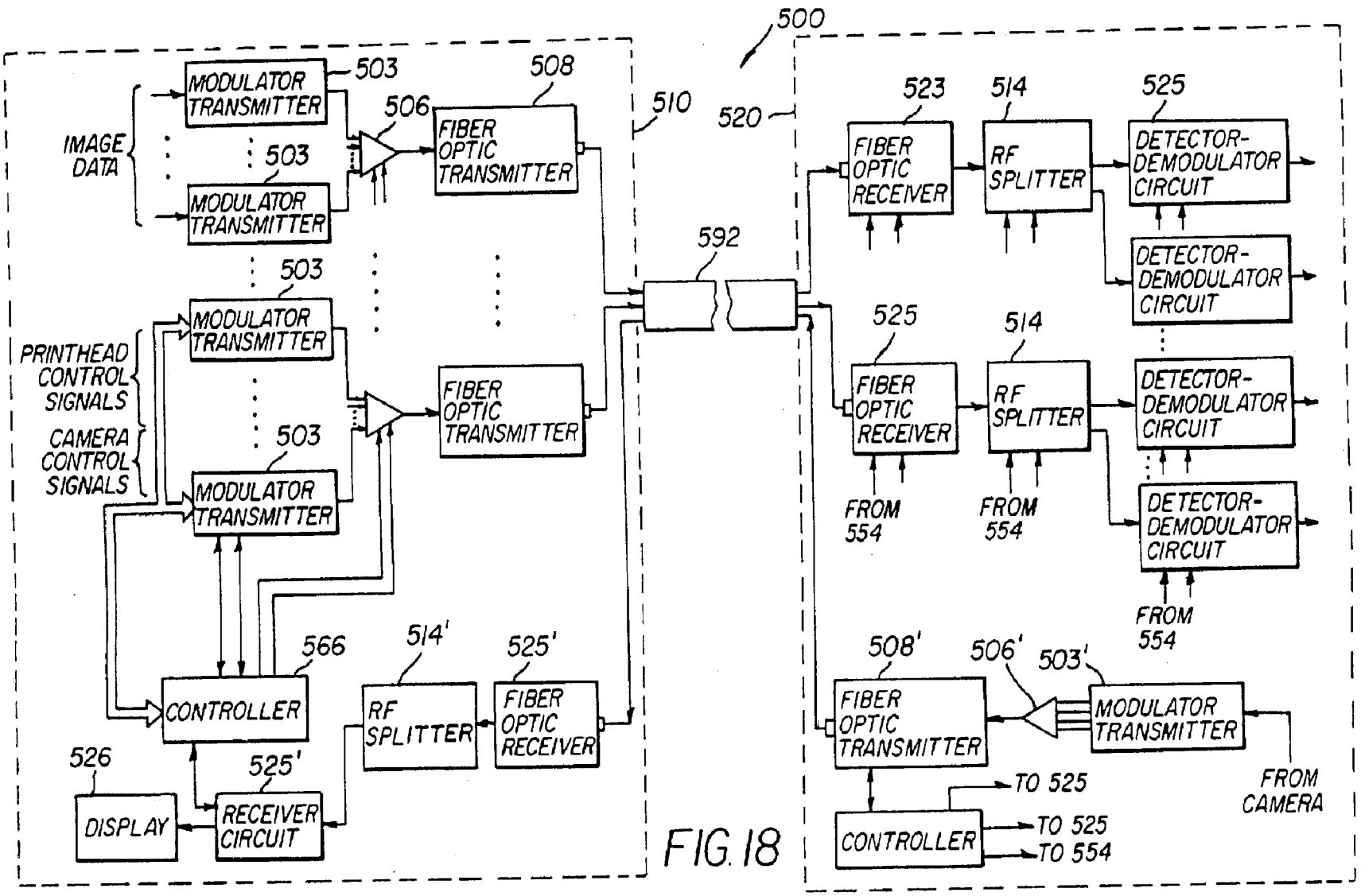
FIG. 18 is a detailed block diagram of a frequency division multiplexed fiber optic interface.

The multiplexing technique used to fold in discrete signals destined to the fiber optic transmitter is not limited to time division multiplexing technique. Any multiplexing technique can be used to realize the best use of the bandwidth available in the fiber optic cable. FIG. 18 illustrates a circuit showing an application utilizing frequency division multiplexing technique for a portion of the interface signals between the data path and control electronics and the print head assembly. Frequency division multiplexing has the advantage of being a nonsampling method of the signal, and has been a technique used to multiplex continuous waveform type signals such as those utilized for the distribution and transmission of television.

In this example, the bandwidths of each of the individual signals add up to the total bandwidth required of the fiber optic link. The discrete signals must be converted to an intermediate radio signal form prior to being converted to light form. The electrical circuits for this purpose are shown as item 510 in FIG. 18 and include an RF modulator-transmitter 503, multiplexer 506 and fiber optic transmitter 508. For illustrative purposes the discrete signals are converted to frequency shift keyed (FSK) format signals. In this design the FSK transmitter and receiver signal frequencies are picked to (1) provide adequate bandwidth for the discrete signals and (2) Conform to standard engineering values of components that are readily available and (3) Provide adequate signal isolation or to minimize interference of signals to others that share the medium. Each discrete signal is assigned a FSK radio channel. The channels are of sufficient bandwidth to be spaced at 10 Megahertz intervals apart such that the first digital (discrete) signal is assigned to a 46 MHz frequency, the second to 56 MHz, and so on until all discrete channels that can be accommodated are assigned for this fiber link for transmission over the same fiber channel. If the application requires that higher bandwidth signals such as television video used for a remote camera was to be transmitted from print head carriage to the control electronics, a wider bandwidth, and thus a greater channel spacing would be assigned for its respective FSK radio channel.

Figure 22:
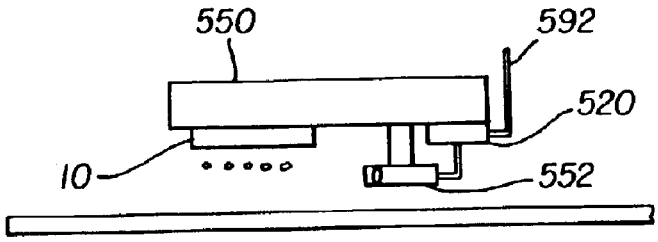
FIG. 22 is a sketch illustrating the printhead support on a carriage having a video camera, digital camera or scanner.

In this regard, reference is made to FIG. 22 wherein there are shown a carriage 550 that supports the printhead 10 and a video camera 552 that is connected for movement with the carriage. The video camera is aimed at the printhead to examine functionality of ejection of ink from the respective nozzles. Signals from the camera representing whether or not ink has been ejected are transmitted over a coaxial cable to the interface 520 for return processing along with control signals that are sent to the controller. As an alternative the camera may be a scanner for scanning an image that has been printed by the printer and providing feedback via the fiber optic link to a controller that can compare the image data with the recorded image determined by the scanner. It may be noted that in FIGS. 17 and 18 circuitry is shown for transmission of the data to the controller 566 on the multiplexing side of the controls. Corresponding circuits to that described above and operative to transmit data from the camera are identified with a prime (′). A display 526 may also be provided for viewing operation of the camera and/or scanner.

Figure 19:
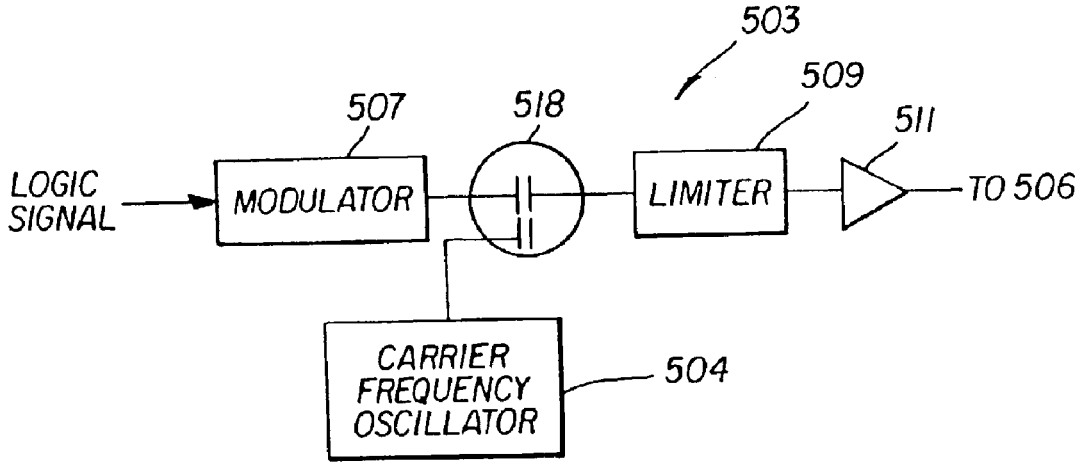
FIG. 19 is a detailed block diagram of the transmitter section of the frequency division multiplexed fiber optic interface.

In FIG. 19 there is shown some of the functional blocks of the modulator-transmitter 503. The modulator-transmitter includes a modulator 507 and a mixer 518 that modulates the center frequency of the radio channel generated by local oscillator 504, providing a carrier frequency, for logic representation of the discrete signal. A representative discrete signal such as the one assigned to the 46 MHz channel has the modulator 507 shift the center frequency by +1.2 MHz to represent a logic 1 value of the discrete signal, and similarly, a shift of −0.2 MHz represents a logic 0 value of the signal. The RF multiplexer 506 (FIG. 18) combines the RF channels representing discrete signals onto the electrical input of the fiber optic transmitter 508. The transmitter then places the collection of radio (discrete) signals into a light wave form to be transmitted over fiber cable 592, and on to fiber optic receiver 525. The output of the mixer 518 may be input to a bandwidth limiter 509 to limit the extent of the bandwidth of the signals transmitted to the multiplexer 506. An amplifier 511 may be also provided to provide gain to the signal output by the mixer 518 and the bandwidth limiter.

Figure 20:
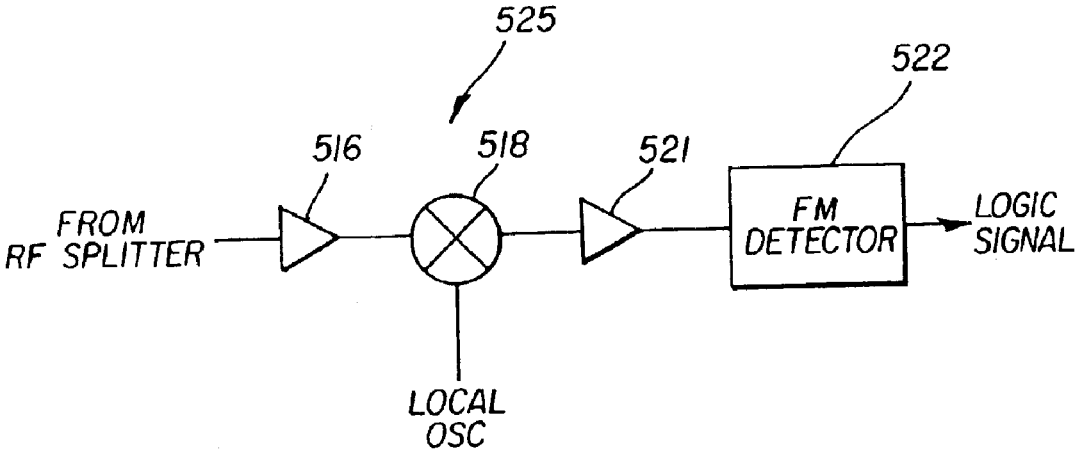
FIG. 20 is a detailed block diagram of the receiver section of the frequency division multiplexed fiber optic interface.

As was done in the embodiment utilizing the time division multiplexing technique, the discrete signals are recovered with a fiber optic receiver circuit 520 located on the print head or the printer carriage assembly and which includes a fiber optic receiver 523, RF splitter 514 and a detector-demodulator circuit 525. In FIG. 20 functional block diagrams of certain portions of the detector-demodulator circuit 525 are illustrated. The radio signals of FSK format for each channel are distributed by splitter circuit 514 to a preamplifier 516, and the digital form of the discrete signal is recovered using standard superhetrodyne FSK receiver design. Here the signal passes through a wideband preamplifier 516, followed by a mixer 518 and selective IF amplifier 521 and ultimately to the FM detector circuit 522 where the discrete digital signal is recovered. At the detector circuit 522, the recovered signal frequency is compared to the center frequency of the channel to determine the logic level of the signal. A microprocessor based controller 566 on the multiplexing side may be provided as well as another microprocessor based controller 554 being provided on the demultiplexing side. In addition signals from a video camera or scanner as described above with regard to FIG. 22 may be multiplexed-de multiplexed processed over the fiber optic link using the FSK circuitry on the respective circuits 510,520. Block diagrams of circuits for use for this purpose which are similar to circuits used for handling data are indicated with a prime (').

Figure 21:
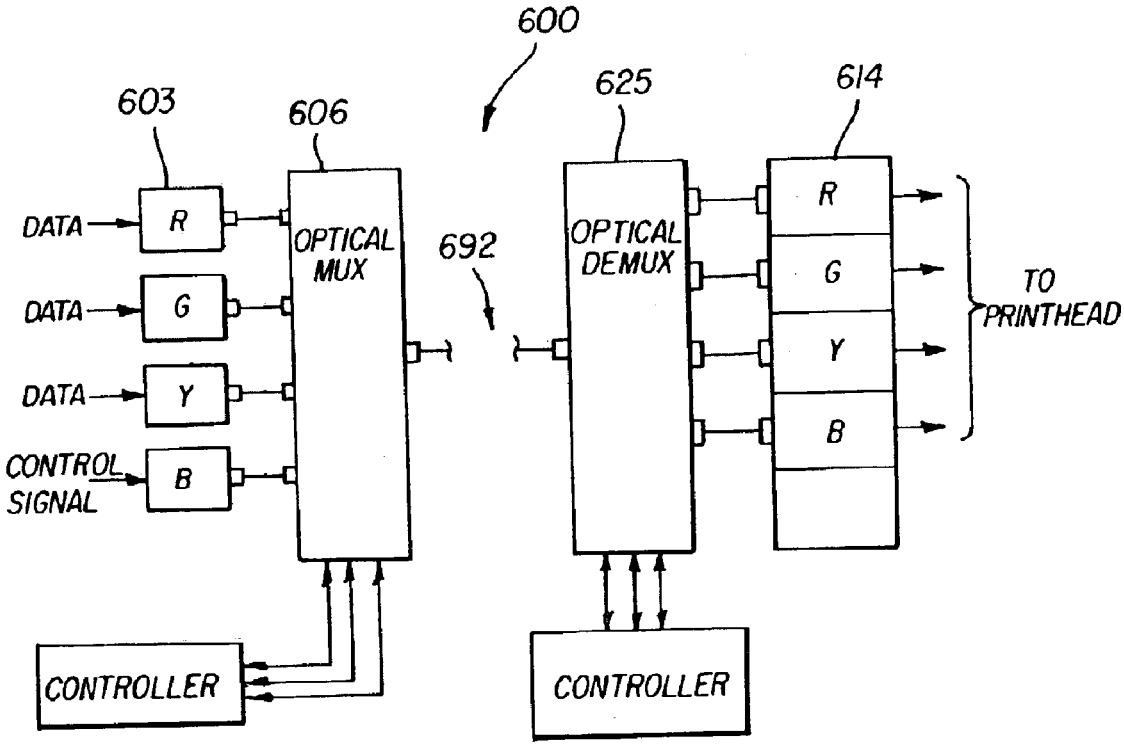
FIG. 21 is a detailed block diagram of a fiber optic interface that employs light at different color frequencies to transmit data over a fiber optic interface.

With reference to FIG. 21, still another embodiment of a fiber optic multiplexing-de multiplexing connection may be provided for transferring image data and control signals to a printhead located on a moving carriage. In the embodiment to FIG. 21 data and control signals are input into respective modulators 603 that output light of respective different colors. The modulators 603 are linked by fibers or other optical connections to an optical multiplexer 606 the output of which is connected via a fiber optic link 692 to an optical demultiplexer 625. The outputs of the optical demultiplexer are input to respective color demodulators 614 which form image signals that can be presented to a printhead as described above.

While this invention has been described with reference to illustrative embodiments, this description is not intended to be construed in a limiting sense. For example, the principles of the invention can be applied to other types of recording elements, such as LEDs, thermal recording elements, lasers, and other recording element configurations. As such, various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A printer apparatus comprising:

a carriage supported for movement in a fast scan direction of printing on a receiver medium, the carriage supporting a printhead for recording information on the receiver medium, the printhead having a plurality of recording elements;

first electronic circuitry mounted on the carriage for bi-directional movement with the carriage;

an optical data link for providing to the first electronic circuitry image data signals for recording by the printhead;

second electronic circuitry located remotely from the carriage and coupled to the first electronic circuitry by the optical data link, the second electronic circuitry providing multiplexed image data signals for transmission to the optical data link; and wherein the second electronic circuitry includes a multiplexer for multiplexing image data signals for transmission to the optical data link and the first electronic circuitry includes a demultiplexer for demultiplexing the image data signals, and wherein the multiplexer employs time division multiplexing to multiplex the image data signals.

2. The apparatus of claim 1 and wherein the multiplexed image data signals comprise electrical signals that are converted to optical signals.

3. The apparatus of claim 1 wherein the first electronic circuitry on the carriage includes a shift register comprising a plurality of shift register stages and wherein said plurality of shift register stages are interleaved so that a signal defining image data received from one shift register stage for output to one actuator of plural actuators associated with one recording element is coupled to another shift register stage for shifting data into said another shift register stage, and wherein the shift register is operative during a shifting operation to shift data from said one shift register stage to said another shift register stage, and wherein data output from said another shift register stage is used to control operation of a second actuator forming a part of said plural actuators associated with said one recording element.

4. The apparatus according to claim 1 and wherein the first electronic circuitry on the carriage includes a shift register comprising a plurality of shift register stages and wherein said plurality of shift register stages are interleaved so that a signal defining image data received from one shift register stage for output to one actuator of plural actuators associated with one recording element is coupled to another shift register stage for shifting data into said another shift register stage, and wherein the shift register is operative during a shifting operation to shift data from said one shift register stage to said another shift register stage, and wherein data output from said another shift register stage is used to control operation of a second actuator forming a part of said plural actuators associated with said one recording element.

5. The apparatus according to claim 1 and wherein each of the recording elements has similar plural actuators so that different counterpart actuators are provided for each actuator, and further wherein said first electronic circuitry includes a shift register comprising a plurality of shift register stages, each stage being associated with a respective actuator, each recording element being associated with plural different shift register stages, the shift register stages being adapted to shift data from one stage to a next stage to distribute data to the different stages so that data shifted into a shift register stage associated with one counterpart actuator for one recording element may be shifted directly into a shift register stage associated with a second counterpart actuator associated with a different recording element than the one recording element in the course of shifting data from shift register stage to shift register stage.

6. The apparatus according to claim 1 and wherein the recording elements comprise nozzles of an ink jet printhead.

7. The apparatus according to claim 6 and wherein the carriage includes a camera for observing ink drops generated by the printhead.

8. The apparatus according to claim 7 and including an optical fiber connection between the carriage and circuitry remote from the carriage for conveying signals from the camera to the circuitry remote from the carriage.

9. The apparatus according to claim 6 and wherein the carriage includes a scanner for generating signals relative to information recorded on the receiver by the printhead.

10. The apparatus according to claim 9 and including an optical fiber connection between the carriage and circuitry remote from the carriage for conveying signals from the scanner to the circuitry remote from the carriage.

11. The apparatus according to claim 1 wherein the carriage includes a scanner for observing a recording by the printhead.

12. A printer apparatus comprising:

a carriage supported for movement in a fast scan direction of printing on a receiver medium, the carriage supporting a printhead for recording information on the receiver medium, the printhead having a plurality of recording elements;

first electronic circuitry mounted on the carriage for bi-directional movement with the carriage;

an optical data link for providing to the first electronic circuitry image data signals for recording by the printhead;

second electronic circuitry located remotely from the carriage and coupled to the first electronic circuitry by the optical data link, the second electronic circuitry providing multiplexed image data signals for transmission to the optical data link; and wherein the second electronic circuitry includes a multiplexer for multiplexing image data signals for transmission to the optical data link and the first electronic circuitry includes a demultiplexer for demultiplexing the image data signals, wherein the multiplexer employs frequency division multiplexing.

13. The apparatus of claim 12 and wherein the multiplexed image data signals comprise electrical signals that are converted to intermediate radio signals and then to optical signals.

14. The apparatus of claim 13 and wherein the electrical signals are in the form of frequency shift keyed format signals.

15. The apparatus of claim 14 and wherein a modulator is provided which modulates the center frequency of a radio channel.

16. The apparatus of claim 15 and wherein the first electronic circuitry on the carriage includes a superheterodyne receiver circuit for converting radio signals of frequency shift keyed format to electrical signals.

17. The apparatus of claim 16 and wherein the first electronic circuitry on the carriage includes a shift register comprising a plurality of shift register stages and wherein said plurality of shift register stages are interleaved so that a signal defining image data received from one shift register stage for output to one actuator of plural actuators associated with one recording element is coupled to another shift register stage for shifting data into said another shift register stage, and wherein the shift register is operative during a shifting operation to shift data from said one shift register stage to said another shift register stage, and wherein data output from said another shift register stage is used to control operation of a second actuator forming a part of said plural actuators associated with said one recording element.

18. The apparatus of claim 12 and wherein the first electronic circuitry on the carriage includes a shift register comprising a plurality of shift register stages and wherein said plurality of shift register stages are interleaved so that a signal defining image data received from one shift register stage for output to one actuator of plural actuators associated with one recording element is coupled to another shift register stage for shifting data into said another shift register stage, and wherein the shift register is operative during a shifting operation to shift data from said one shift register stage to said another shift register stage, and wherein data output from said another shift register stage is used to control operation of a second actuator forming a part of said plural actuators associated with said one recording element.

19. The apparatus according to claim 12 wherein the recording elements comprise nozzles of an ink jet printhead.

20. The apparatus according to claim 12 wherein the carriage includes a scanner for observing a recording by the printhead.

21. A printer apparatus comprising:

a carriage supported for movement in a fast scan direction of printing on a receiver medium, the carriage supporting a printhead for recording information on the receiver medium, the printhead having a plurality of recording elements;

first electronic circuitry mounted on the carriage for bi-directional movement with the carriage;

an optical data link for providing to the first electronic circuitry image data signals for recording by the printhead;

second electronic circuitry located remotely from the carriage and coupled to the first electronic circuitry by the optical data link, the second electronic circuitry providing multiplexed image data signals for transmission to the optical data link; and wherein the second electronic circuitry includes a multiplexer for multiplexing image data signals for transmission to the optical data link and the first electronic circuitry includes a demultiplexer for demultiplexing the image data signals, wherein the carriage includes a camera for observing an operation of the printhead.

22. The apparatus according to claim 21 and including an optical fiber connection between the carriage and circuitry remote from the carriage for conveying signals from the camera to the circuitry remote from the carriage.

23. The apparatus according to claim 22 and including a display for displaying operation of the printhead in response to signals from the camera.

24. A printer apparatus comprising:

a carriage supported for movement in a fast scan direction of printing on a receiver medium, the carriage supporting a printhead for recording information on the receiver medium, the printhead having a plurality of recording elements;

first electronic circuitry mounted on the carriage for bi-directional movement with the carriage;

an optical data link for providing to the first electronic circuitry image data signals for recording by the printhead;

second electronic circuitry located remotely from the carriage and coupled to the first electronic circuitry by the optical data link, the second electronic circuitry providing multiplexed image data signals for transmission to the optical data link; and wherein the second electronic circuitry includes a multiplexer for multiplexing image data signals for transmission to the optical data link and the first electronic circuitry includes a demultiplexer for demultiplexing the image data signals, wherein the carriage includes a scanner for observing a recording by the printhead.

25. The apparatus according to claim 24 and including an optical fiber connection between the carriage and circuitry remote from the carriage for conveying signals from the scanner to the circuitry remote from the carriage.

26. The apparatus according to claim 25 and including a display for displaying operation of the scanner in response to signals from the scanner.

27. A method for transmitting data to a printhead comprising the steps of:

moving a carriage in a fast scan direction while the printhead records on a receiver medium, the carriage supporting the printhead for recording on the receiver medium, the printhead having a plurality of recording elements, and first electronic circuitry being mounted on the carriage for bi-directional movement with the carriage;

providing an optical data link to the first electronic circuitry, the optical data link carrying image data signals from second electronic circuitry remote from the carriage; and multiplexing image data signals for transmission to the optical data link and the first electronic circuitry on the carriage including a demultiplexer that demultiplexes the image data into signals for operation of the printhead wherein time division multiplexing is used to multiplex the image data.

28. The method of claim 27 and wherein the multiplexed image data signals comprise electrical signals that are converted to optical signals.

29. The method of claim 27 and wherein the electronic circuitry on the carriage includes a shift register comprising a plurality of shift register stages and wherein said plurality of shift register stages are interleaved so that a signal defining image data received from one shift register stage for output to one actuator of plural actuators associated with one recording element is coupled to another shift register stage for shifting data into said another shift register stage, and wherein the shift register during a shifting operation shifts data from said one shift register stage to said another shift register stage, and wherein data output from said another shift register stage controls operation of a second actuator forming a part of said plural actuators associated with said one recording element.

30. The method according to claim 27 and wherein each of the recording elements has similar plural actuators so that different counterpart actuators are provided for each actuator, and further wherein the electronic circuitry on the carriage includes a shift register comprising a plurality of shift register stages, each stage being associated with a respective actuator, each recording element being associated with plural different shift register stages, the shift register stages being adapted to shift data from one stage to a next stage to distribute data to the different stages and wherein the shift register, during a shifting operation, shifts data into a shift register stage associated with one counterpart actuator of one recording element and then shifts data directly into a shift register stage associated with a second counterpart actuator associated with a different recording element than the one recording element in the course of shifting data from shift register stage to shift register stage.

31. The method according to claim 30 and wherein the recording elements emit ink or other printing liquid onto the receiver medium.

32. The method according to claim 27 and wherein the recording elements emit ink or other printing liquid onto the receiver medium.

33. The method according to claim 32 and wherein the receiver member is a printing plate.

34. The method according to claim 32 and wherein the carriage includes a camera that observes ink drops generated by the printhead and generates signals in response to observation of ink drops.

35. The method according to claim 34 and wherein an optical fiber connection is provided between the carriage and circuitry remote from the carriage which conveys signals from the camera to the circuitry remote from the carriage.

36. The method according to claim 35 and wherein a display remote from the carriage displays operation of the printhead as observed by the camera.

37. The method according to claim 27 and wherein the carriage includes a camera that observes an operation of the printhead.

38. The method according to claim 37 and wherein an optical fiber connection is provided between the carriage and circuitry remote from the carriage and which conveys signals from the camera to the circuitry remote from the carriage.

39. The method according to claim 38 and wherein a display remote from the carriage displays operation of the printhead in response to signals from the camera.

40. The method according to claim 37 and wherein a display remote from the carriage displays operation of the printhead in response to signals from the camera.

41. The method according to claim 27 and wherein the receiver member is a printing plate.

42. A method for transmitting data to a printhead comprising the steps of:

moving a carriage in a fast scan direction while the printhead records on a receiver medium, the carriage supporting the printhead for recording on the receiver medium, the printhead having a plurality of recording elements, and first electronic circuitry being mounted on the carriage for bi-directional movement with the carriage;

providing an optical data link to the first electronic circuitry, the optical data link carrying image data signals from second electronic circuitry remote from the carriage; and multiplexing image data signals for transmission to the optical data link and the first electronic circuitry on the carriage including a demultiplexer that demultiplexes the image data into signals for operation of the printhead, wherein frequency division multiplexing is used to multiplex the image data signals.

43. The method of claim 42 and wherein the multiplexed image data signals comprise electrical signals that are converted to intermediate radio signals and then to optical signals.

44. The method of claim 43 and wherein the electrical signals are in the form of frequency shift keyed format signals.

45. The method of claim 44 and wherein a modulator is provided which modulates the center frequency of a radio channel.

46. A method for transmitting data to a printhead comprising the steps of:

moving a carriage in a fast scan direction while the printhead records on a receiver medium, the carriage supporting the printhead for recording on the receiver medium, the printhead having a plurality of recording elements, and first electronic circuitry being mounted on the carriage for bi-directional movement with the carriage;

providing an optical data link to the first electronic circuitry, the optical data link carrying image data signals from second electronic circuitry remote from the carriage; and multiplexing image data signals for transmission to the optical data link and the first electronic circuitry on the carriage including a demultiplexer that demultiplexes the image data into signals for operation of the printhead, wherein the carriage includes a scanner for generating signals relative to information recorded on the receiver medium by the printhead.

47. The method according to claim 46 and wherein there is provided an optical fiber connection between the carriage and circuitry remote from the carriage which conveys signals from the scanner to the circuitry remote from the carriage.

48. A method for transmitting data to a printhead comprising the steps of:

moving a carriage in a fast scan direction while the printhead records on a receiver medium, the carriage supporting the printhead for recording on the receiver medium, the printhead having a plurality of recording elements, and first electronic circuitry being mounted on the carriage for bi-directional movement with the carriage;

providing an optical data link to the first electronic circuitry, the optical data link carrying image data signals from second electronic circuitry remote from the carriage; and multiplexing image data signals for transmission to the optical data link and the first electronic circuitry on the carriage including a demultiplexer that demultiplexes the image data into signals for operation of the printhead, wherein the carriage includes a scanner for observing a recording by the printhead and a display remote from the camera displays observations of the scanner.

49. The method according to claim 48 and wherein an optical fiber connection between the carriage and circuitry remote from the carriage conveys signals from the scanner to the circuitry remote from the carriage for display by the display.

50. A printer apparatus comprising:

a carriage supported for movement in a fast scan direction of printing on a receiver medium, the carriage supporting a printhead for recording information on the receiver medium, the printhead having a plurality of recording elements;

first electronic circuitry mounted on the carriage for bi-directional movement with the carriage;

an optical data link for providing to the first electronic circuitry image data signals for recording by the printhead;

second electronic circuitry located remotely from the carriage and coupled to the first electronic circuitry by the optical data link, the second electronic circuitry providing multiplexed image data signals for transmission to the optical data link; and wherein the second electronic circuitry includes a multiplexer for multiplexing image data signals for transmission to the optical data link and the first electronic circuitry includes a demultiplexer for demultiplexing the image data signals, wherein the carriage includes a camera for observing an operation of the printhead.

51. A method for transmitting data to a printhead comprising the steps of:

moving a carriage in a fast scan direction while the printhead records on a receiver medium, the carriage supporting the printhead for recording on the receiver medium, the printhead having a plurality of recording elements, and first electronic circuitry being mounted on the carriage for bi-directional movement with the carriage;

providing an optical data link to the first electronic circuitry, the optical data link carrying image data signals from second electronic circuitry remote from the carriage; and multiplexing image data signals for transmission to the optical data link and the first electronic circuitry on the carriage including a demultiplexer that demultiplexes the image data into signals for operation of the printhead, wherein the carriage includes a camera that observes an operation of the printhead.

* * * * *